US007886876B2

(12) United States Patent
Carpenter et al.

(10) Patent No.: US 7,886,876 B2
(45) Date of Patent: Feb. 15, 2011

(54) ON BOARD OIL RESERVOIR FOR LUBRICATING PISTON PAINT PUMP

(75) Inventors: Scott R. Carpenter, Rogers, MN (US); Robert D. Cooper, Jr., Elk River, MN (US); Stephen K. Liedtke, Chanhassen, MN (US)

(73) Assignee: Wagner Spray Tech Corporation, Plymouth, MN (US)

( * ) Notice: Subject to any disclaimer, the term of this patent is extended or adjusted under 35 U.S.C. 154(b) by 1029 days.

(21) Appl. No.: 11/263,336

(22) Filed: Oct. 31, 2005

(65) Prior Publication Data

US 2007/0137938 A1 Jun. 21, 2007

(51) Int. Cl.
*F16N 1/00* (2006.01)

(52) U.S. Cl. ..... 184/24; 184/6.5; 184/15.1; 184/26; 184/27.1; 184/28; 222/136; 222/144.5; 222/146.1; 417/415; 417/545; 417/552

(58) Field of Classification Search ..... 184/24
See application file for complete search history.

(56) References Cited

U.S. PATENT DOCUMENTS

| | | | | |
|---|---|---|---|---|
| 2,395,653 | A * | 2/1946 | Attwood | 112/256 |
| 2,944,538 | A * | 7/1960 | Conway et al. | 123/196 CP |
| 3,305,137 | A | 2/1967 | Gauthier et al. | |
| 3,332,411 | A | 7/1967 | Bloom et al. | |
| 3,776,369 | A | 12/1973 | Schrack et al. | |
| 3,779,669 | A * | 12/1973 | Sommer | 417/214 |
| 4,802,555 | A * | 2/1989 | Matsunaga et al. | 184/15.1 |
| 6,435,846 | B1 * | 8/2002 | Cooper et al. | 417/415 |
| 2003/0015375 | A1 * | 1/2003 | Yokotani et al. | 184/24 |

FOREIGN PATENT DOCUMENTS

| | | |
|---|---|---|
| DE | 1577694 | 4/1970 |
| FR | 2136408 | 12/1972 |
| JP | 10217778 A * | 8/1998 |

OTHER PUBLICATIONS

International Search Report and Written Opinion of International Application No. PCT/US2006/060220.

* cited by examiner

*Primary Examiner*—Robert A Siconolfi
*Assistant Examiner*—San Aung
(74) *Attorney, Agent, or Firm*—Faegre & Benson LLP

(57) ABSTRACT

Apparatus and method for on-board lubrication of a paint pumping piston including a reservoir for lubricant and a lubricant dispensing mechanism for delivering a predetermined repeatable amount of lubricant upon manual actuation of the lubricant dispensing mechanism. In one embodiment, a section of tubing acts as the reservoir, and in another embodiment, the reservoir is formed by a transparent or translucent chamber located adjacent an aperture in a pump housing to enable visual inspection of the level of lubricant in the reservoir. A lubricant delivery piston is actuated by an extension thereof projecting through an aperture in the housing, and a lubricant discharge nozzle is located adjacent the paint pumping piston proximate a bushing supporting the paint pumping piston. A breather valve prevents a vacuum in the reservoir as the lubricant is dispensed.

7 Claims, 30 Drawing Sheets

ON BOARD OIL RESERVOIR FOR LUBRICATING PISTON PAINT PUMP

BACKGROUND OF THE INVENTION

In the past, piston paint pumps of the type having a paint pumping piston required periodic lubrication of the paint pumping piston by a user who was instructed (by the owner's manual) to insert a spout of an oil can into an opening in the pump housing and align the spout with the top of the piston where it projected from a nut or bushing supporting the paint pumping piston and retaining the top seal of the paint pumping piston assembly. Such a lubrication procedure was found to be inconvenient and therefore less likely to be performed as often as appropriate. Because the oil was stored in a can separate from the pump, it was also inconvenient for a user to locate the oil can when lubrication was intended to be performed.

The present invention overcomes deficiencies of the prior art by providing an on board lubrication system on the pump. The system includes an oil reservoir and a prepositioned permanently installed spout located to deliver the oil to the piston-bushing interface upon exercise of the system by the user to deliver a predetermined amount of oil to the piston-bushing interface.

SUMMARY OF THE INVENTION

The invention includes an on board apparatus having a lubrication reservoir and lubricant dispensing mechanism operable to deliver a predetermined volume of oil to the piston-nut interface in a piston paint pump. A pushbutton extends through an aperture in the pump housing to enable the user to move the predetermined volume of oil from the reservoir to the piston-bushing interface. A filler tube and cap is provided in the pump housing to enable a user to initially fill and periodically refill the oil reservoir. The cap preferably has a breather valve to prevent a vacuum in the reservoir, which would interfere with the operation of the lubrication system.

In one embodiment, a transparent or translucent oil reservoir is mounted adjacent an aperture in the housing to enable viewing of the level of oil in the reservoir.

DETAILED DESCRIPTION OF THE INVENTION

Figure 1:
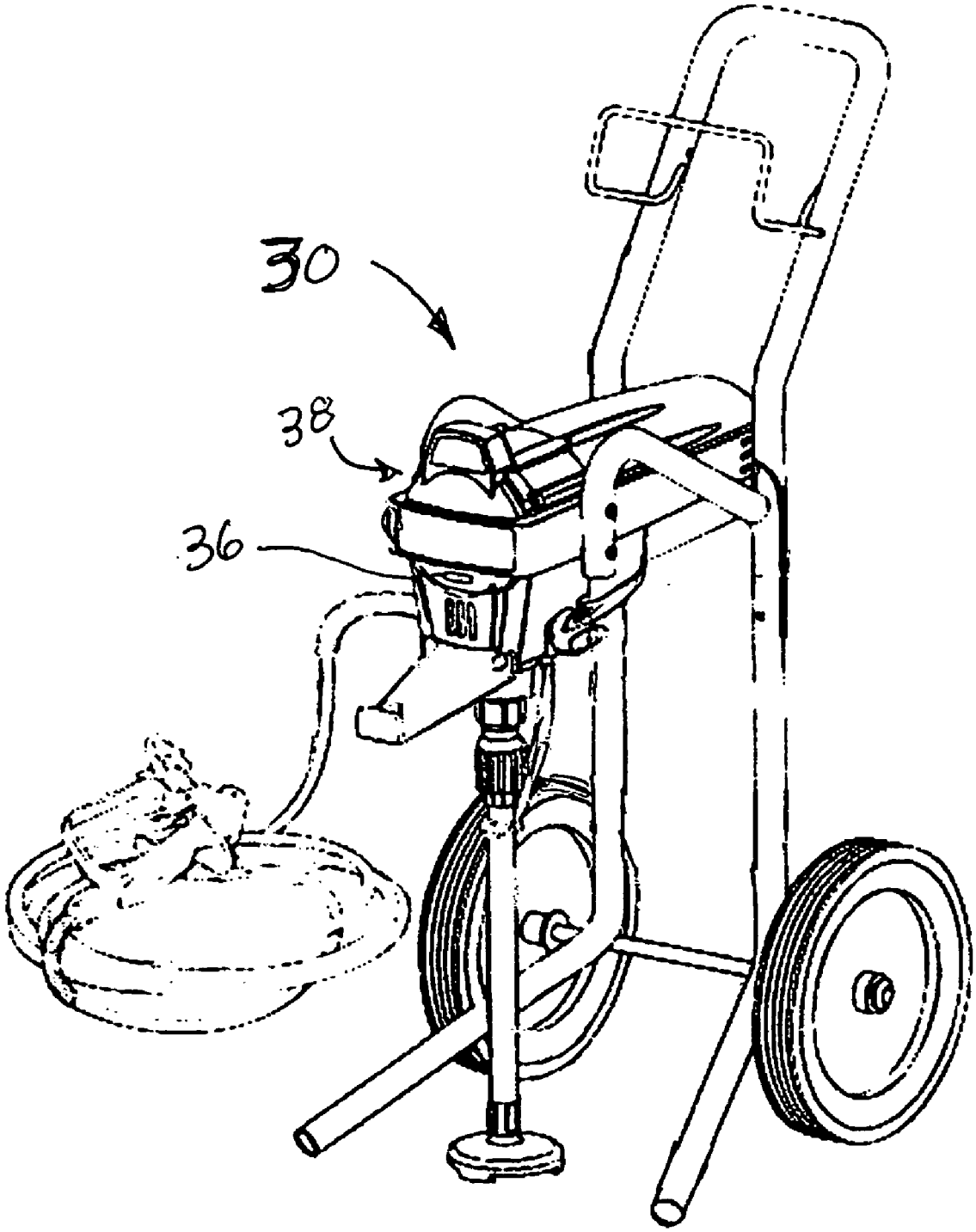
FIG 1 PRIOR ART
FIG. 1 is a perspective view of a piston pump useful in the practice of the present invention.
Figure 2:
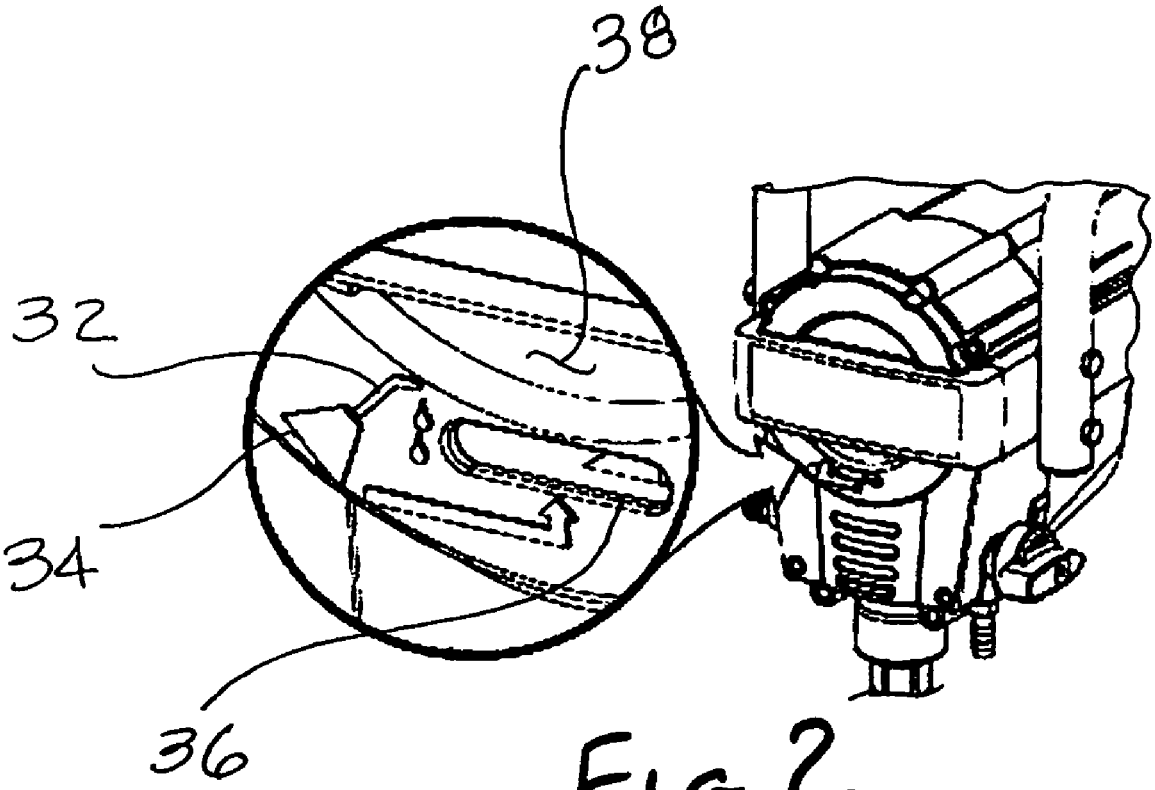
FIG 2 PRIOR ART
FIG. 2 is a fragmentary view of a diagram of a prior art apparatus and method for manually lubricating a piston paint pump.
Figure 3:
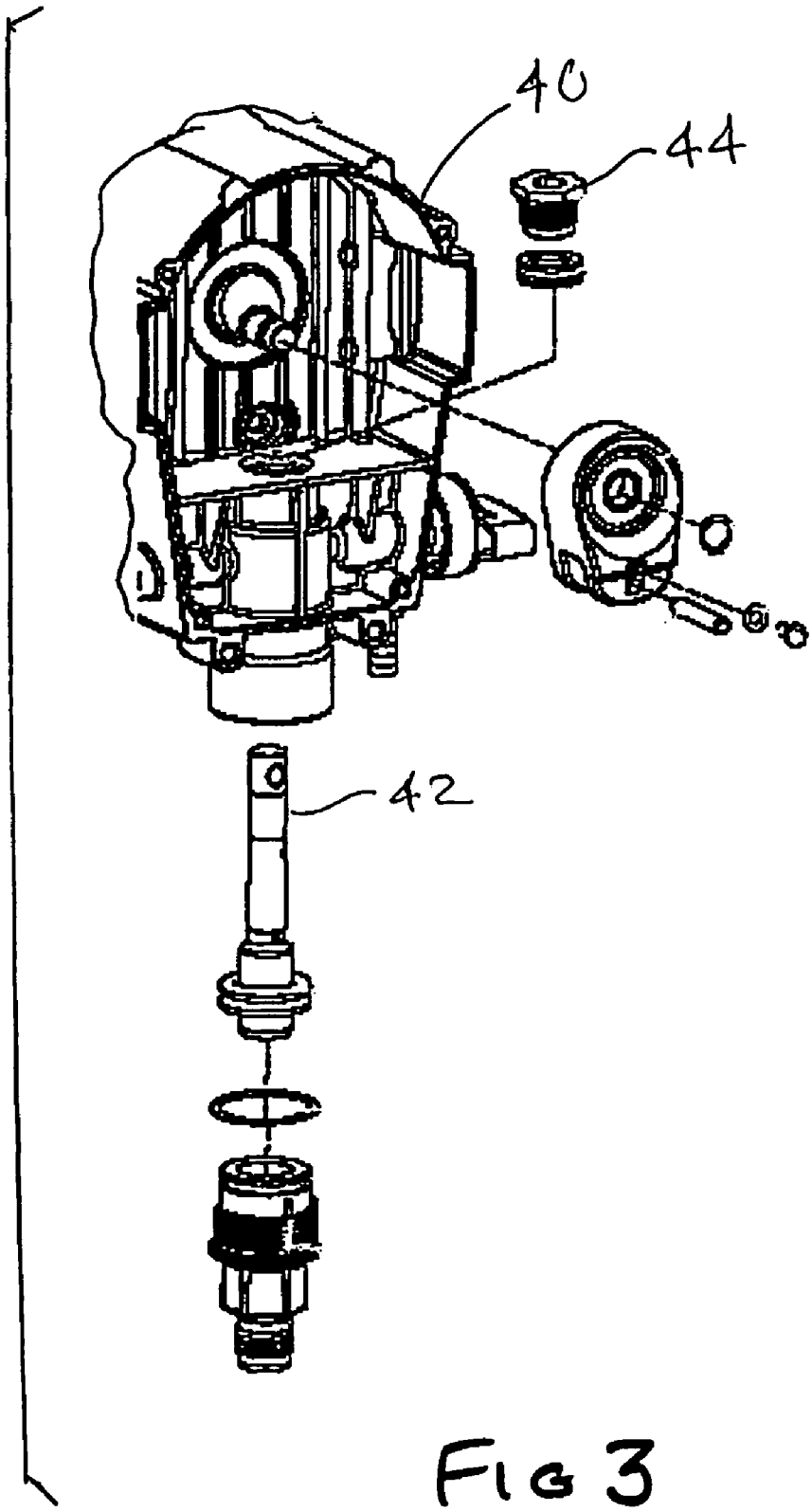
FIG 3 PRIOR ART
FIG. 3 is an exploded fragmentary view of a portion of a prior art piston paint pump with a front cover removed to show details of a piston and bushing to be lubricated using the present invention.
Figure 4:
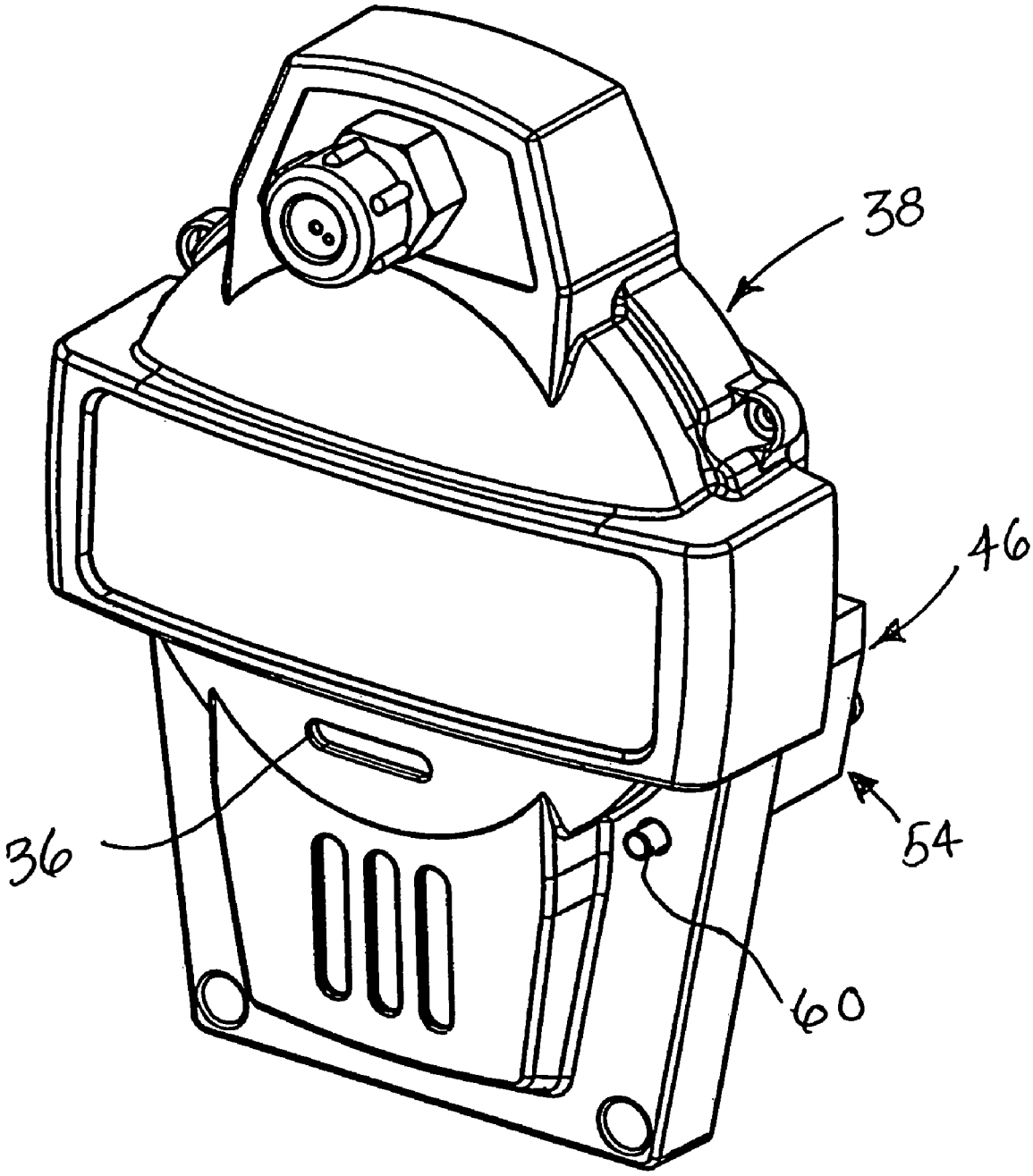
FIG. 4 is a front perspective view of an assembly including a piston paint housing cover with the lubrication system of the present invention installed therein.
Figure 6:
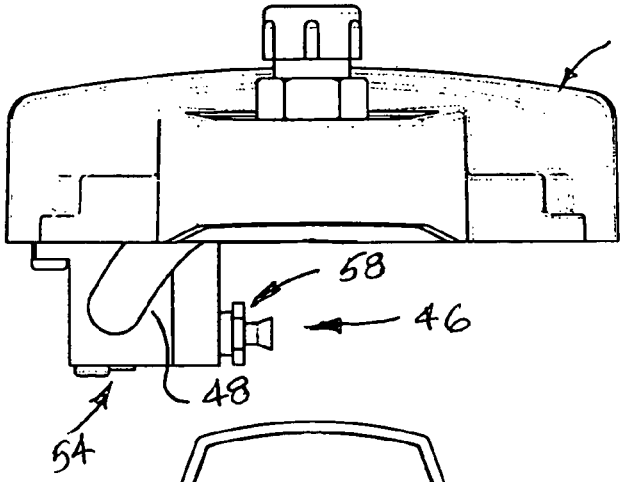
FIG. 6 is a top plan view of the assembly of FIG. 4.
Figure 5:
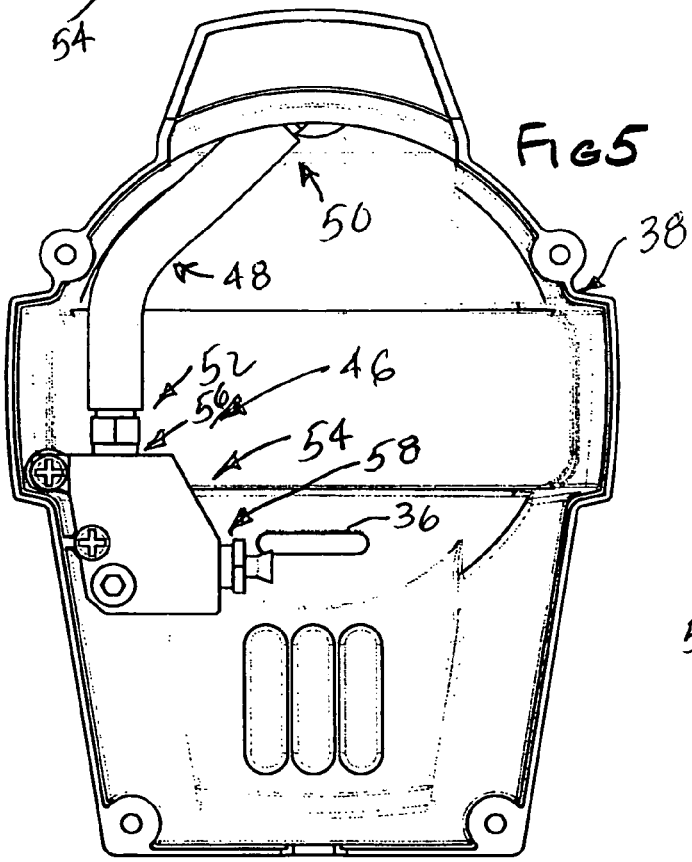
FIG. 5 is a rear elevation view of the assembly of FIG. 4.
Figure 7:
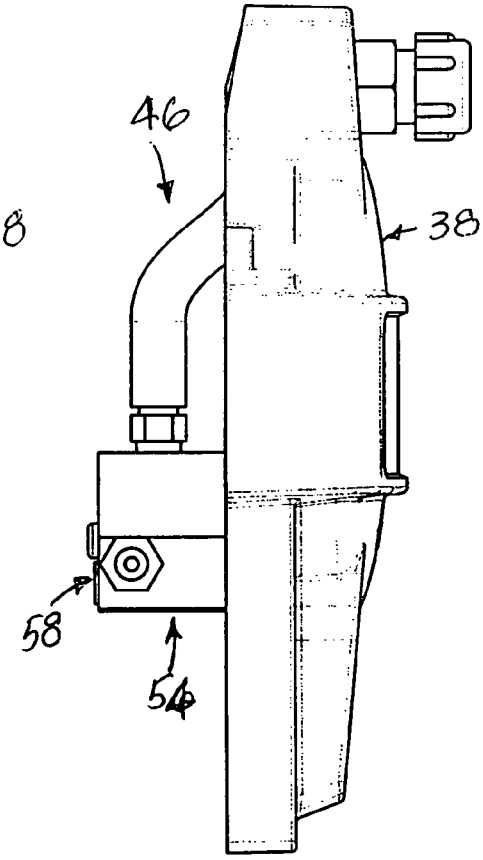
FIG. 7 is a side elevation view of the assembly of FIG. 4.
Figure 8:
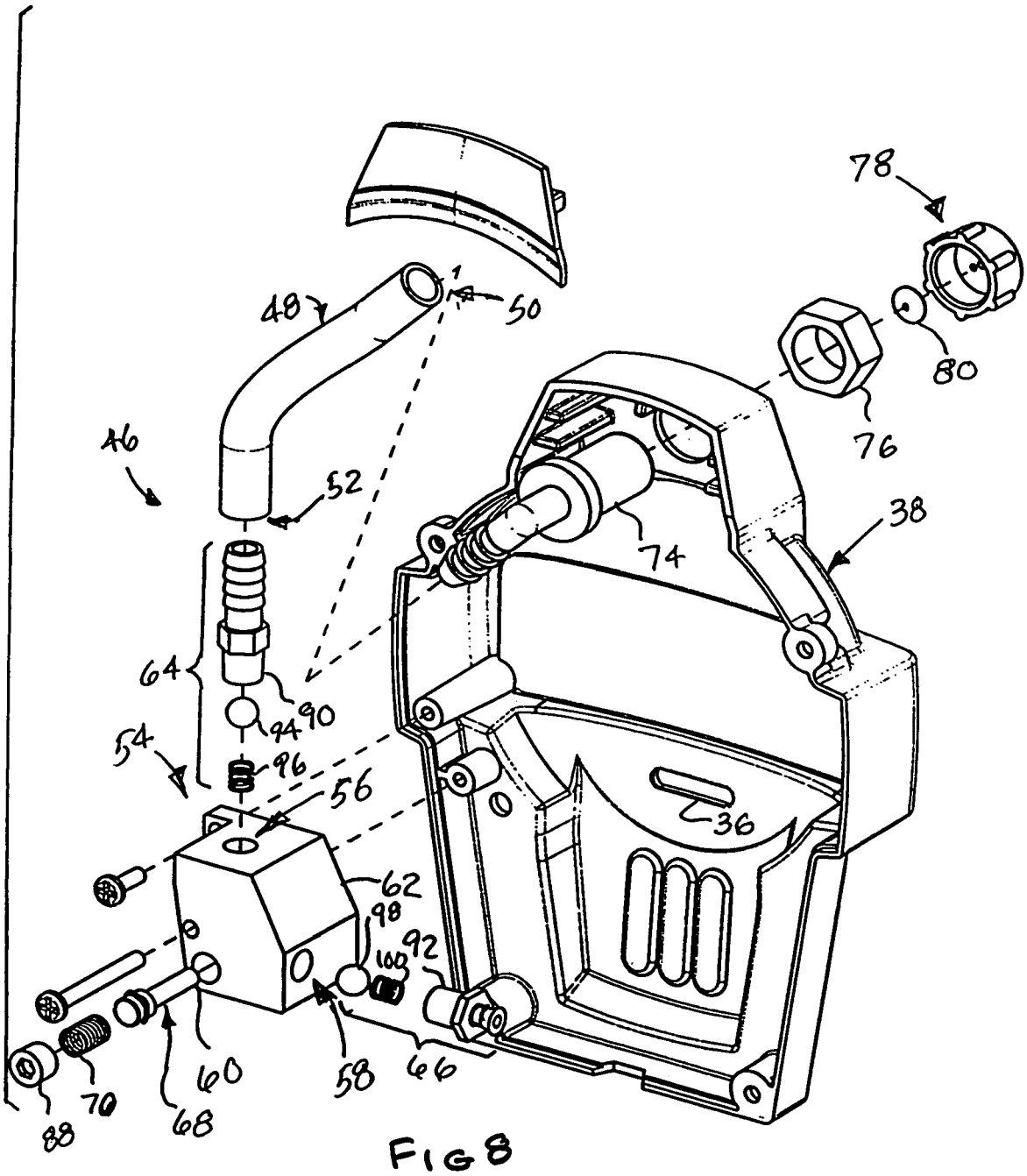
FIG. 8 is a rear perspective exploded view of the assembly of FIG. 4.
Figure 9:
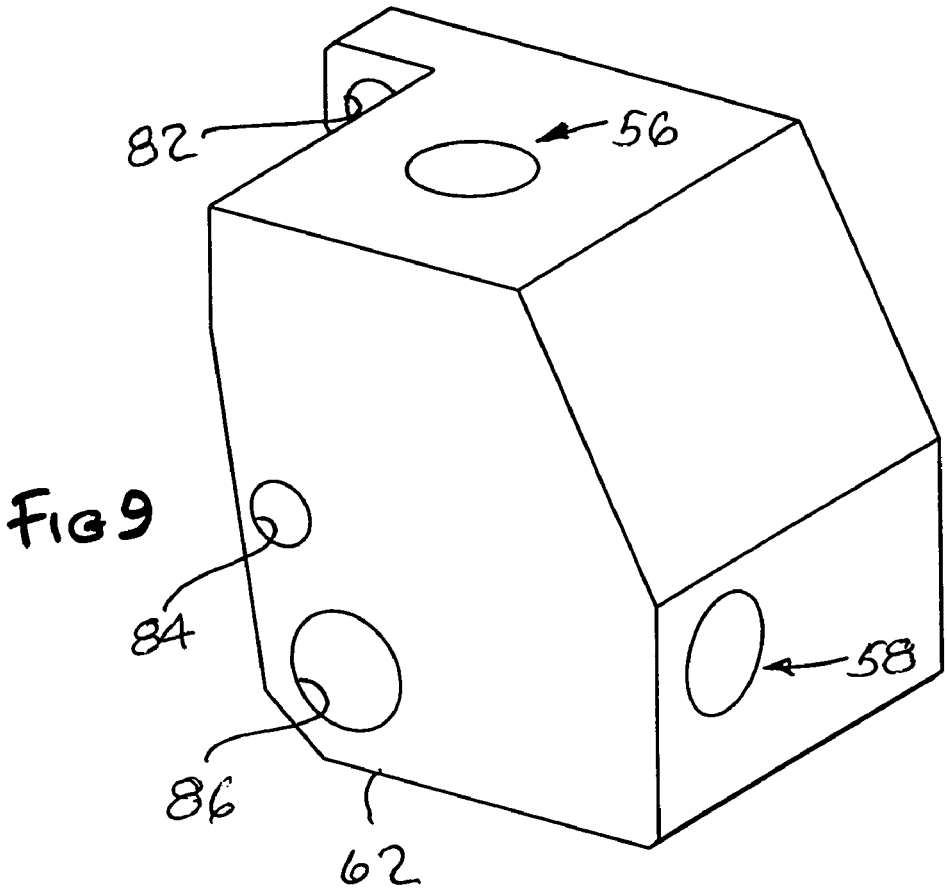
FIG. 9 is a perspective view from the rear and above a housing for a lubricant dispensing mechanism useful in the practice of the present invention.
Figure 10:
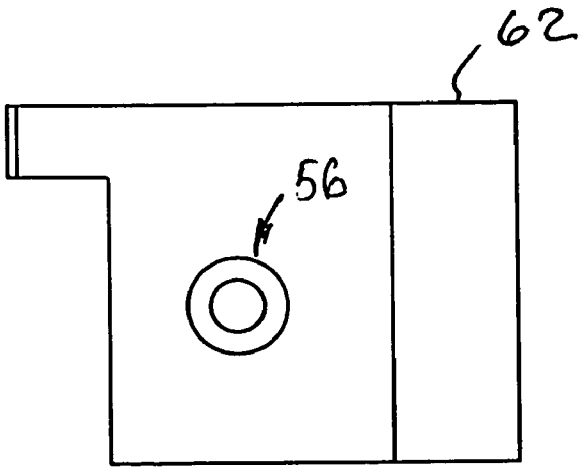
FIG. 10 is a top plan view of the housing of FIG. 9.
Figure 11:
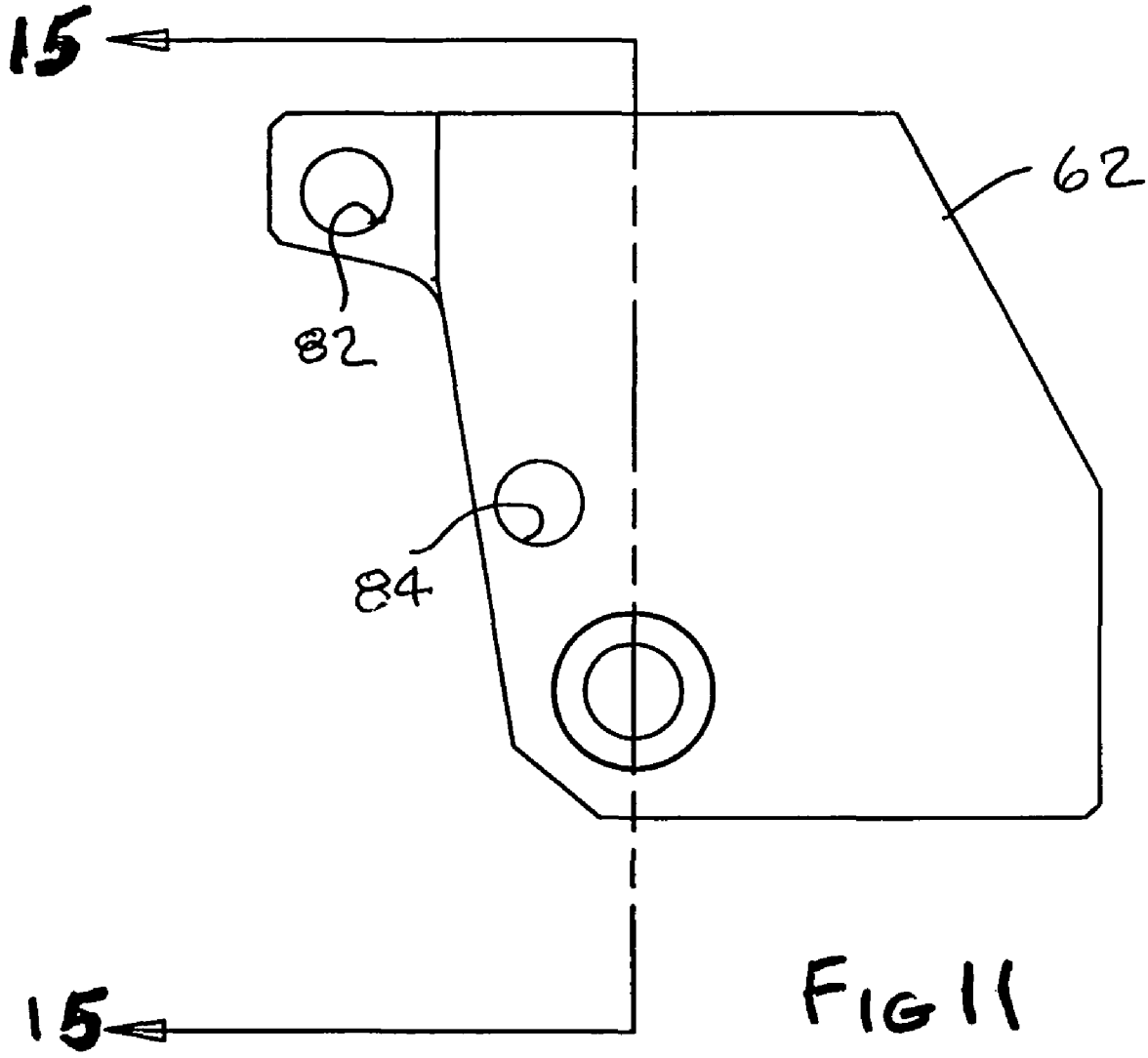
FIG. 11 is a rear elevation view of the housing of FIG. 9.
Figure 12:
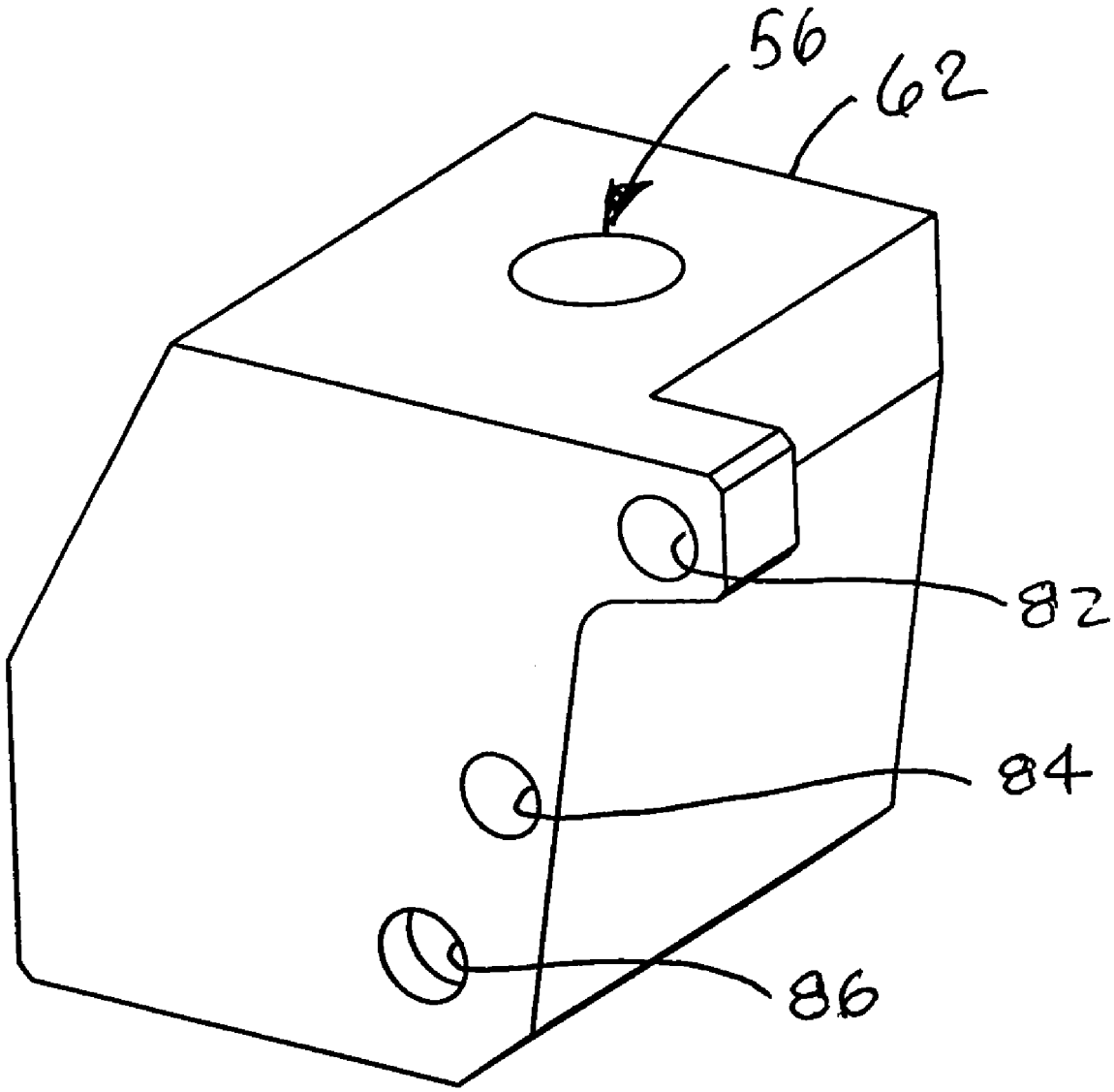
FIG. 12 is a perspective view from the front and above the housing of FIG. 9.
Figure 13:
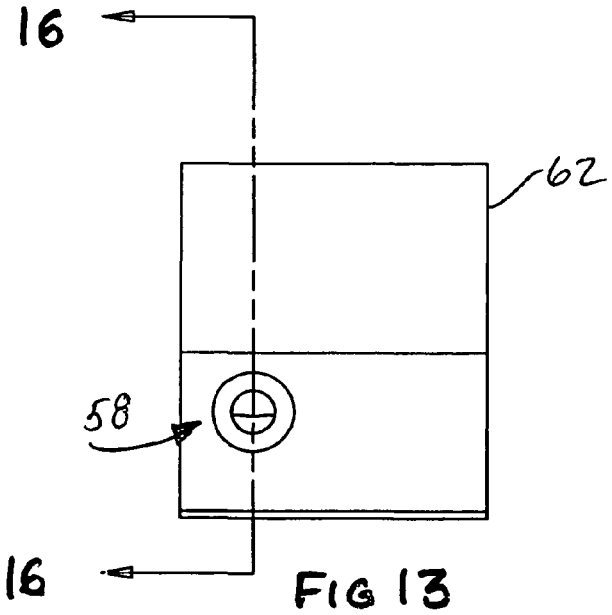
FIG. 13 is a side elevation view of the housing of FIG. 9.
Figure 14:
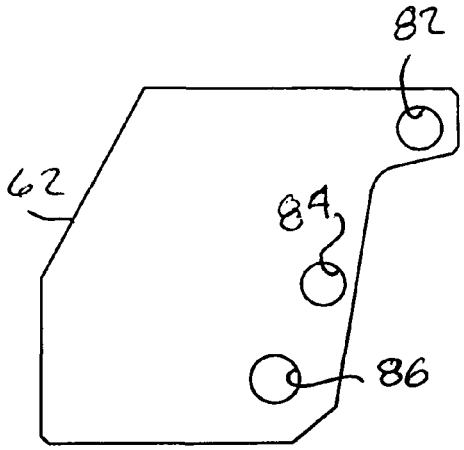
FIG. 14 is a front elevation view of the housing of FIG. 9.
Figure 15:
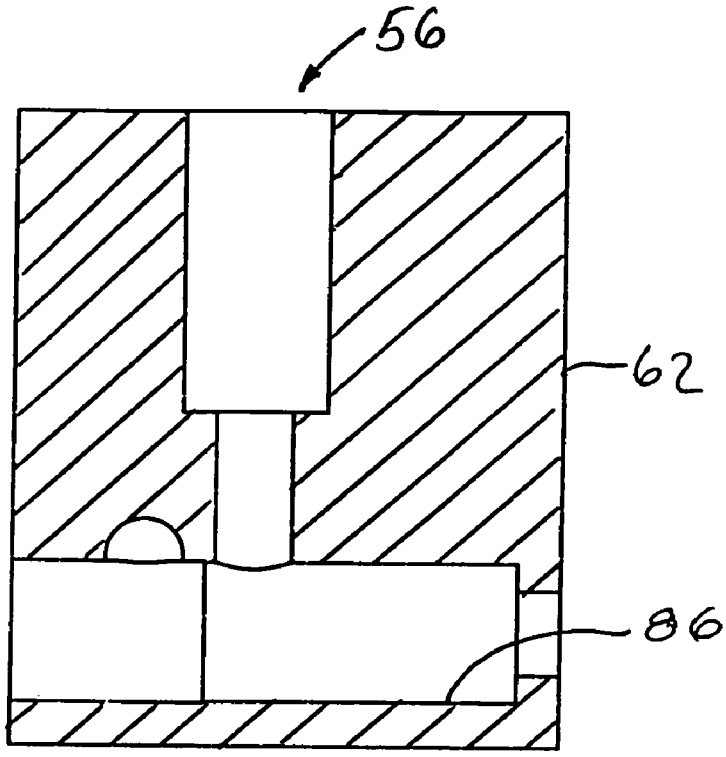
FIG. 15 is a section view of the housing of FIG. 9, taken along line 15-15 of FIG. 11.
Figure 16:
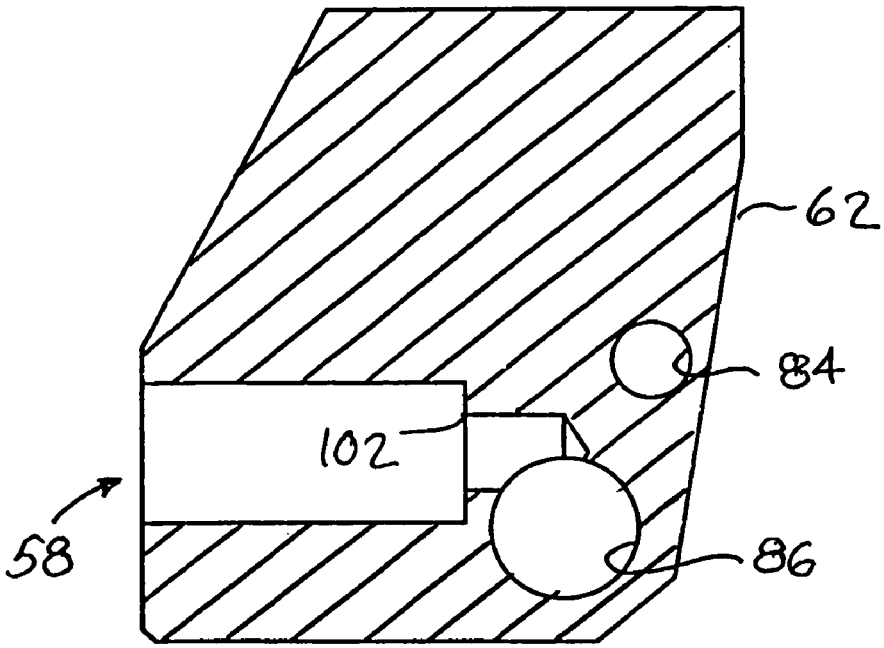
FIG. 16 is a section view of the housing of FIG. 9, taken along line 16-16 of FIG. 13.
Figure 17:
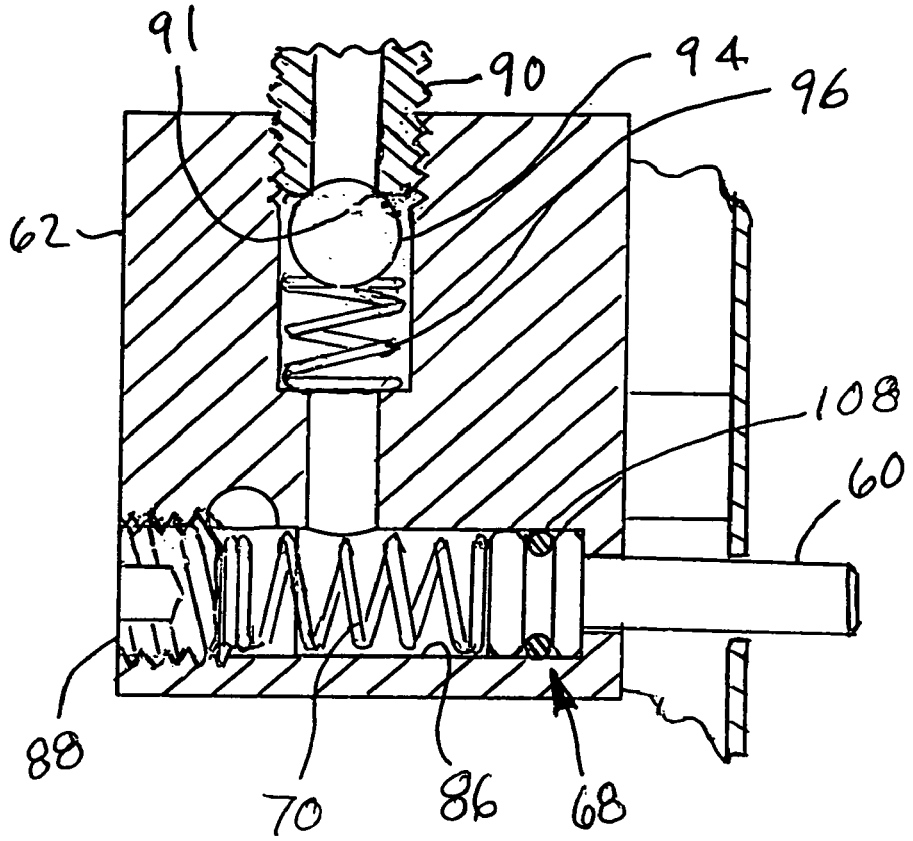
FIG. 17 is a view similar to that of FIG. 15, except showing certain parts installed in the housing.
Figure 18:
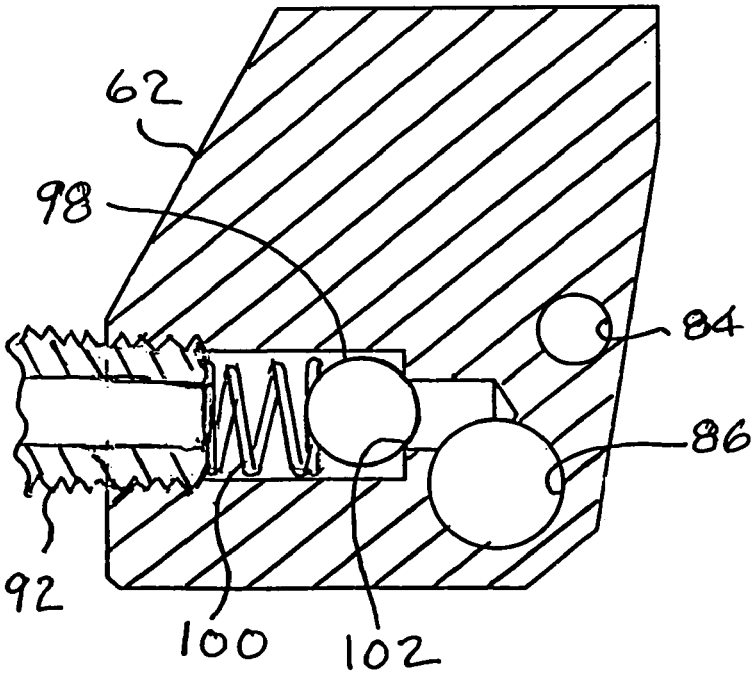
FIG. 18 is a view similar to that of FIG. 16, except showing certain parts installed in the housing.

Referring now to the Figures, and most particularly to FIGS. 1, 2, and 3, a prior art piston paint pump 30 may be seen. The particular pump shown in FIG. 1 is a Model 1920, available from the assignee of the present invention. FIG. 2 shows an illustration from the owner's manual wherein the user is directed to insert a spout 32 of an oil can 34 into an aperture 36 in a cover 38 of a pump housing 40 for periodic lubrication. FIG. 3 shows an exploded view of the front of a paint pump (with the cover removed) in which a paint pumping piston 42 is received in and passes through a nut or bushing 44. The lubrication is to be applied to the piston in the region where it projects from the bushing 44, to minimize wear that would otherwise occur between the paint pumping piston 42 and the bushing 44. With the paint pumping piston 42 and bushing 44 recessed within housing 40, such prior art lubrication was found to be inconvenient.

Referring now to FIGS. 4 through 8, an on-board lubrication system 46 according to the present invention may be seen. System 46 is preferably permanently installed in or on the pump 30, more particularly, in or on the pump housing 40, and most desirably on the cover 38. System 46 preferably includes a lubricant reservoir 48 located internal to the housing 40 of the pump 30. Reservoir 48 has an inlet 50 and an outlet 52. System 46 also includes a lubricant dispensing mechanism 54 having an inlet 56 connected to the outlet 52 of the reservoir 48 and mechanism 54 has an outlet 58 for delivering a predetermined minimum amount of lubricant to the paint pumping piston 42 adjacent the bushing 44 per activation. The system 46 also may have an actuator 60 located exterior of the housing 40 for activation by a user. In one embodiment, the present system provides about 0.01 cubic inches of liquid lubricant per stroke of the actuator 60. User instructions for that system recommend that the user initially activate the actuator between 2 and 5 times to lubricate the piston 42. User instructions go on to recommend pressing the actuator 60 once for every eight hours of pump operation.

The lubricant dispensing mechanism 54 preferably has a housing 62 containing an inlet check valve 64, an outlet check valve 66, a lubricant delivery piston 68 and a return spring 70 for piston 68. Each check valve may be formed by a ball having a spring urging the ball against a seat to block flow in one direction i.e., from the ball towards the seat, and to permit flow in the opposite direction i.e., from the seat towards the ball. The seat may be formed in an end of a threaded fitting received in the housing 62, it being understood that the threads are omitted from some of the figures for simplicity.

The lubricant reservoir 48 may be a hollow tube connected to a fitting 74 projecting through the housing 40 (more particularly the housing cover 38) and in fluid communication with inlet 56 of the mechanism 54 (through the inlet check valve 64). The fitting 74 is secured to cover 38 by a conventional nut 76, with it being understood that fitting 74 has external threads (not shown) mating with internal threads (also not shown) on nut 76. Nut 76 may be made of any suitable material, for example, nylon. A cap 78 (also with internal mating threads, not shown) is received on a projecting end of fitting 74 exterior of cover 38. A breather valve 80 is attached to cap 78 to prevent a vacuum from forming in reservoir 48 as the lubricant is drawn from the reservoir 48.

Referring now also to FIGS. 9-18, various views of the housing 62 may be seen. Housing 62 has a first mounting aperture 82 and a second mounting aperture 84 to secure the mechanism 54 to the cover 38 using conventional machine screws. A stepped bore 86 is sized to receive the lubricant delivery piston 68, while allowing the actuator portion 60 to project out of the housing 62. Although not shown in these views, it is to be understood that bore 86 is threaded to receive a threaded plug 88, shown schematically in FIG. 8 and in section in FIG. 17. It is also to be understood that inlet 56 and outlet 58 are each threaded to receive respectively, inlet check valve fitting 90 and outlet check valve fitting 92, each of which are threaded, as shown in the section views of FIGS. 17 and 18. Housing 62 may be formed of any suitable material, such as aluminum.

Inlet check valve 64 includes the inlet check valve fitting 90, which provides a valve seat 91 on an inboard end thereof, and a ball 94 and spring 96. Outlet check valve 66 includes the outlet check valve fitting 92 and a ball 98 and spring 100. A valve seat 102 for outlet check valve 66 is provided by a step in the bore of outlet 58 in housing 62.

Figure 19:
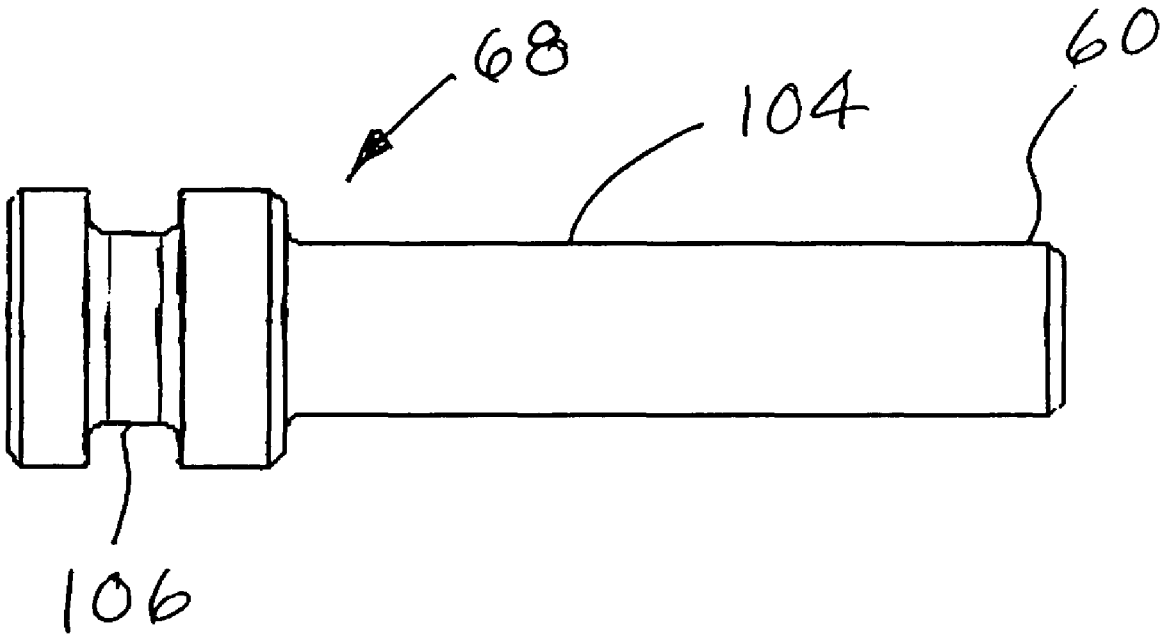
FIG. 19 is a side view of a lubricant dispensing piston useful in the practice of the present invention.

Referring now to FIG. 19, the lubricant delivery piston 68 has a stem 104 forming actuator 60, and a groove 106 to retain an O-ring 108 (shown in FIG. 17) to seal the piston 68 against the bore 86.

Figure 20:
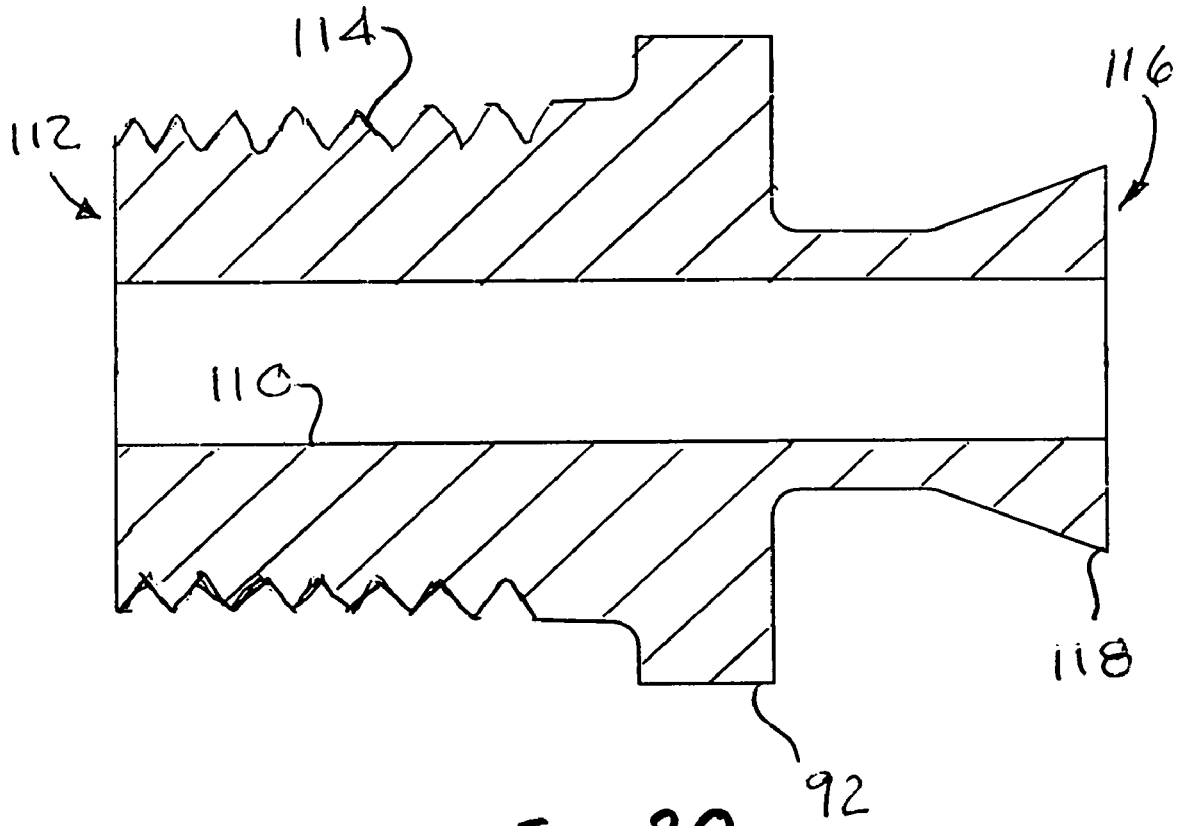
FIG. 20 is a section view of a discharge nozzle useful in the practice of the present invention.

Referring now to FIG. 20, outlet check valve fitting 92 is shown in more detail in cross section. Fitting 92 has a through bore 110 and a first end 112 which has external threads 114 to mate with the internal threads of outlet 58 in housing 62. Through bore extends from the first end 112 to a second end 116 which may have an enlarged perimeter or drip lip 118. Drip lip 118 prevents oil from running back from the second end 116 towards the first end 112. Fitting 92 also serves as a discharge nozzle and, when installed, is located adjacent to and directed at the paint pumping piston 42 proximate the bushing 44. Fitting 92 may be made of any suitable material, such as brass.

Figure 21:
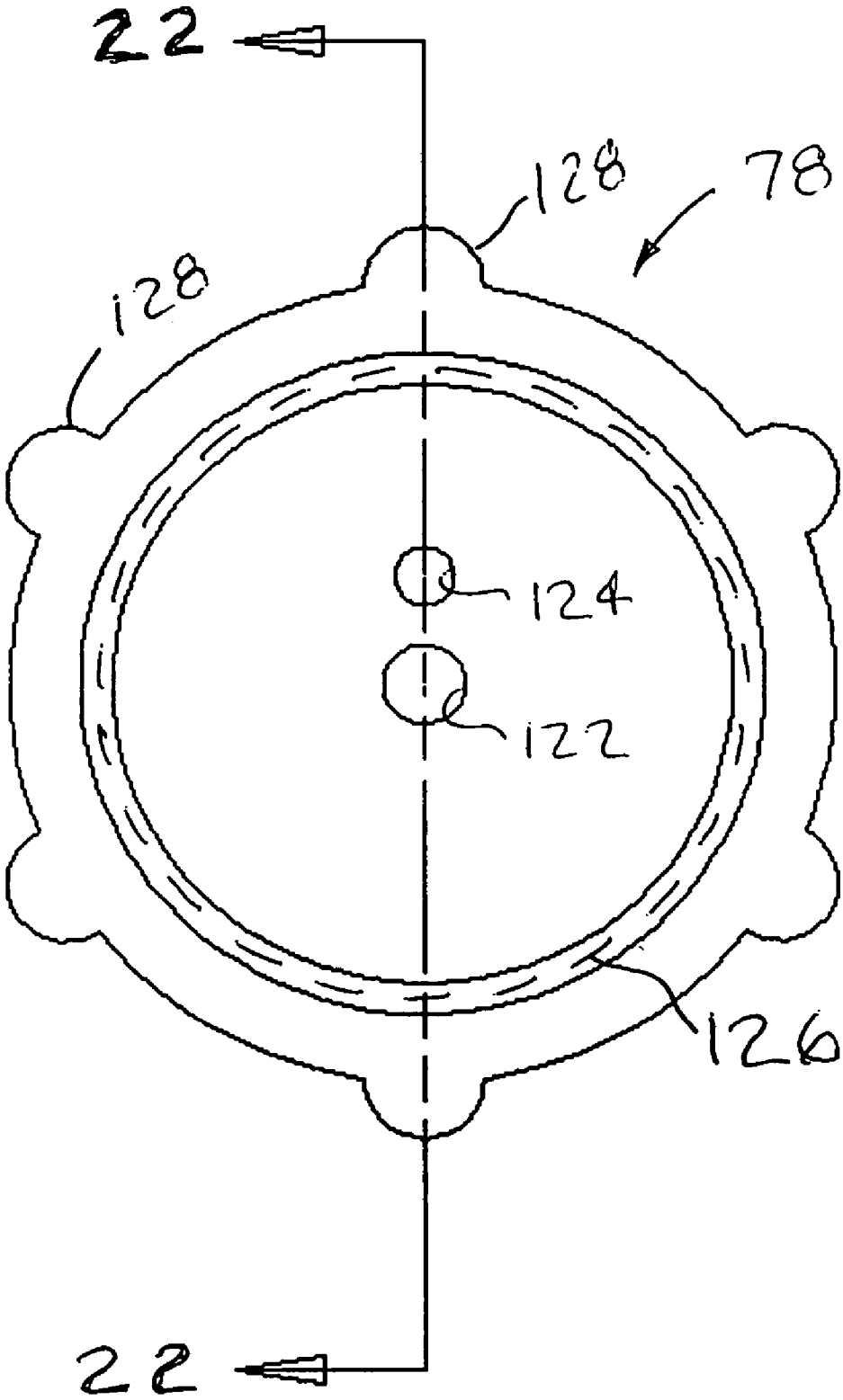
FIG. 21 is an end view of a cap for covering an inlet to a lubricant reservoir in the practice of the present invention.
Figure 22:
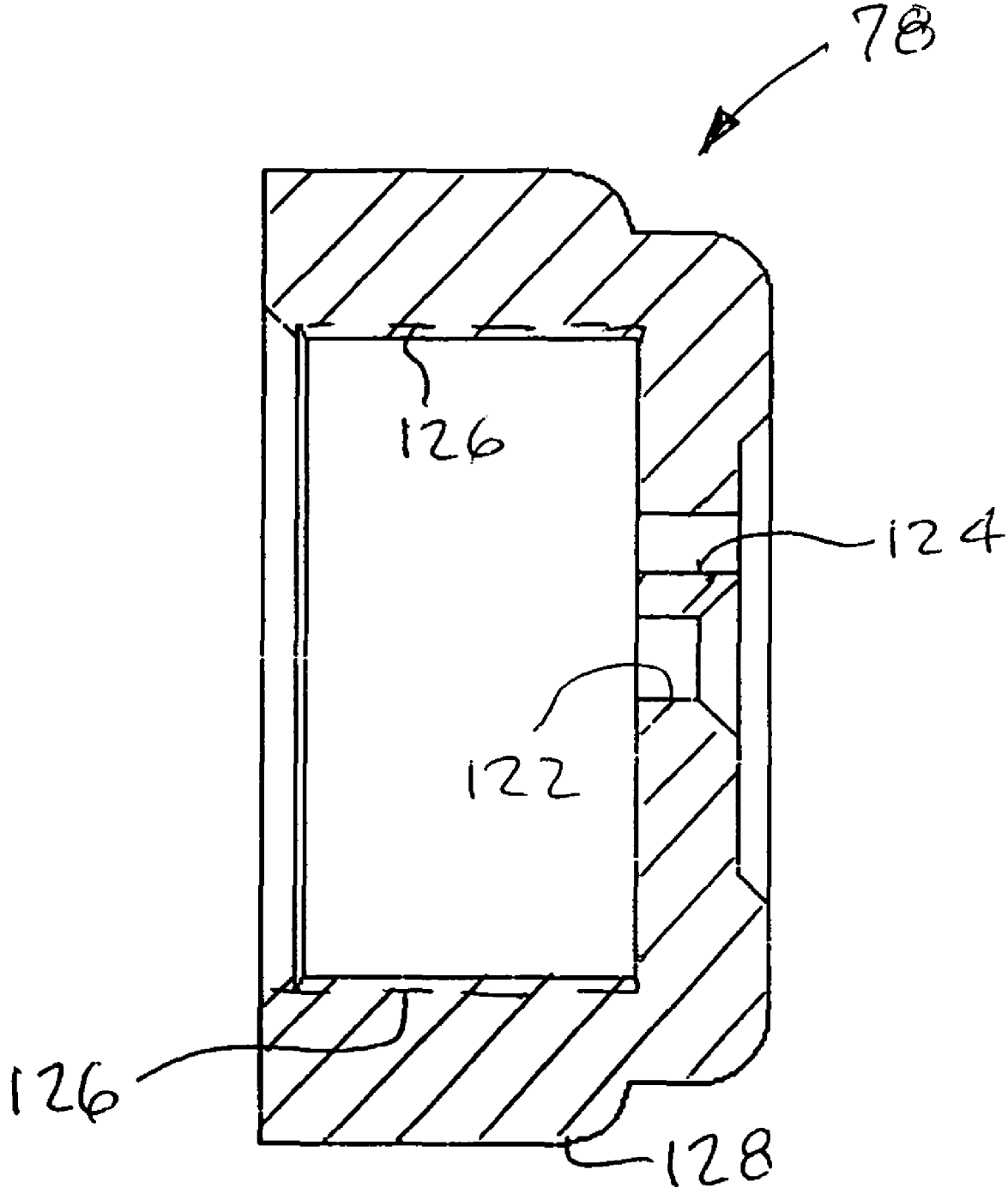
FIG. 22 is a section view along line 22-22 of FIG. 21.
Figure 23:
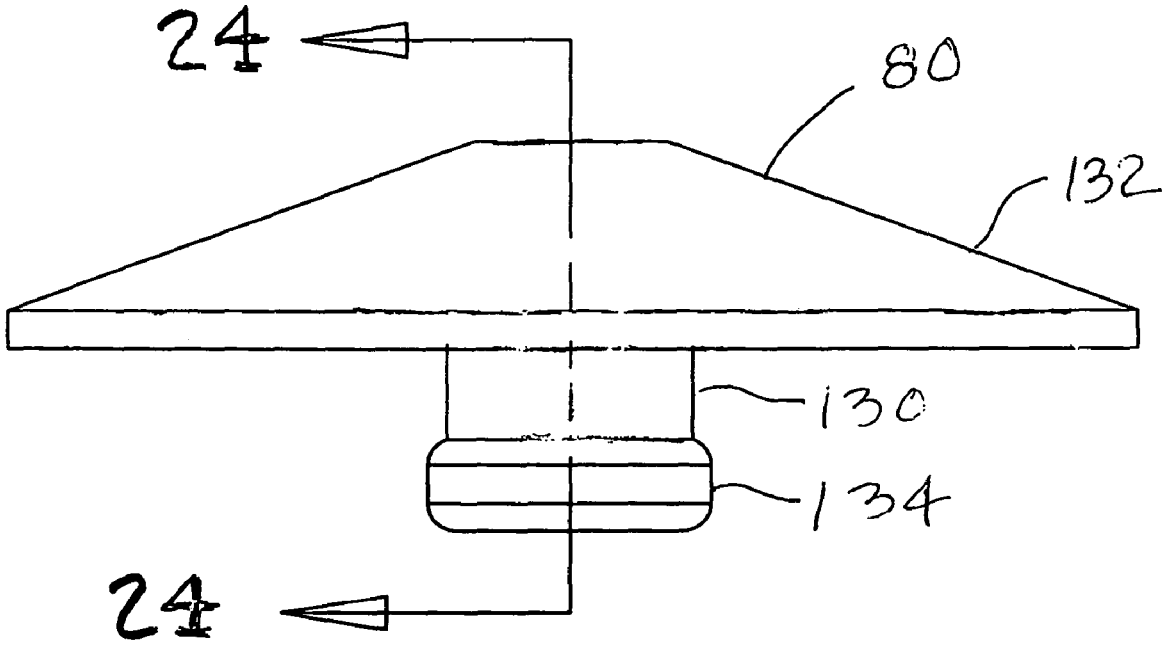
FIG. 23 is a side view of a breather valve element useful with the cap of FIG. 21.
Figure 24:
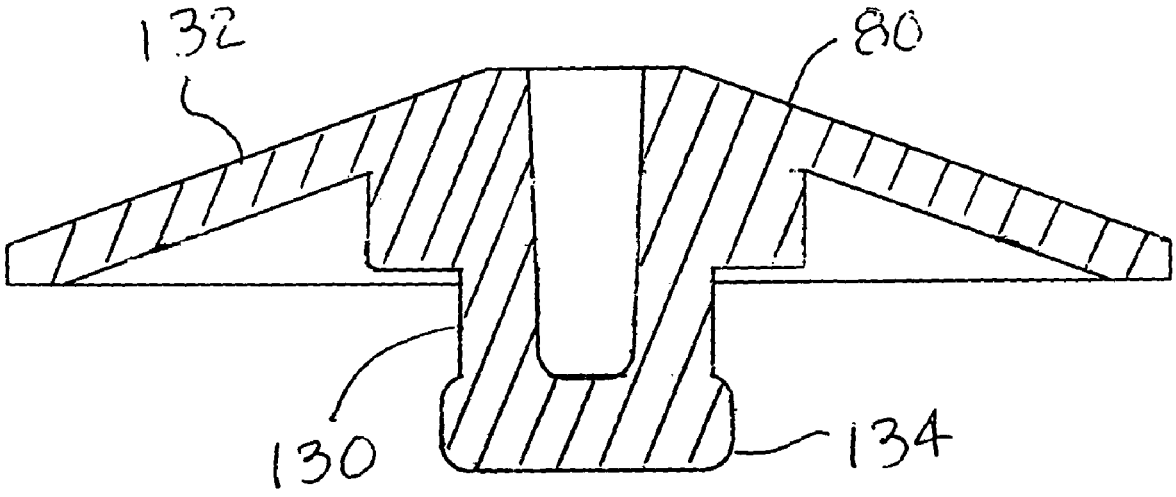
FIG. 24 is a section view of the breather valve element taken along line 24-24 of FIG. 23.
Figure 25:
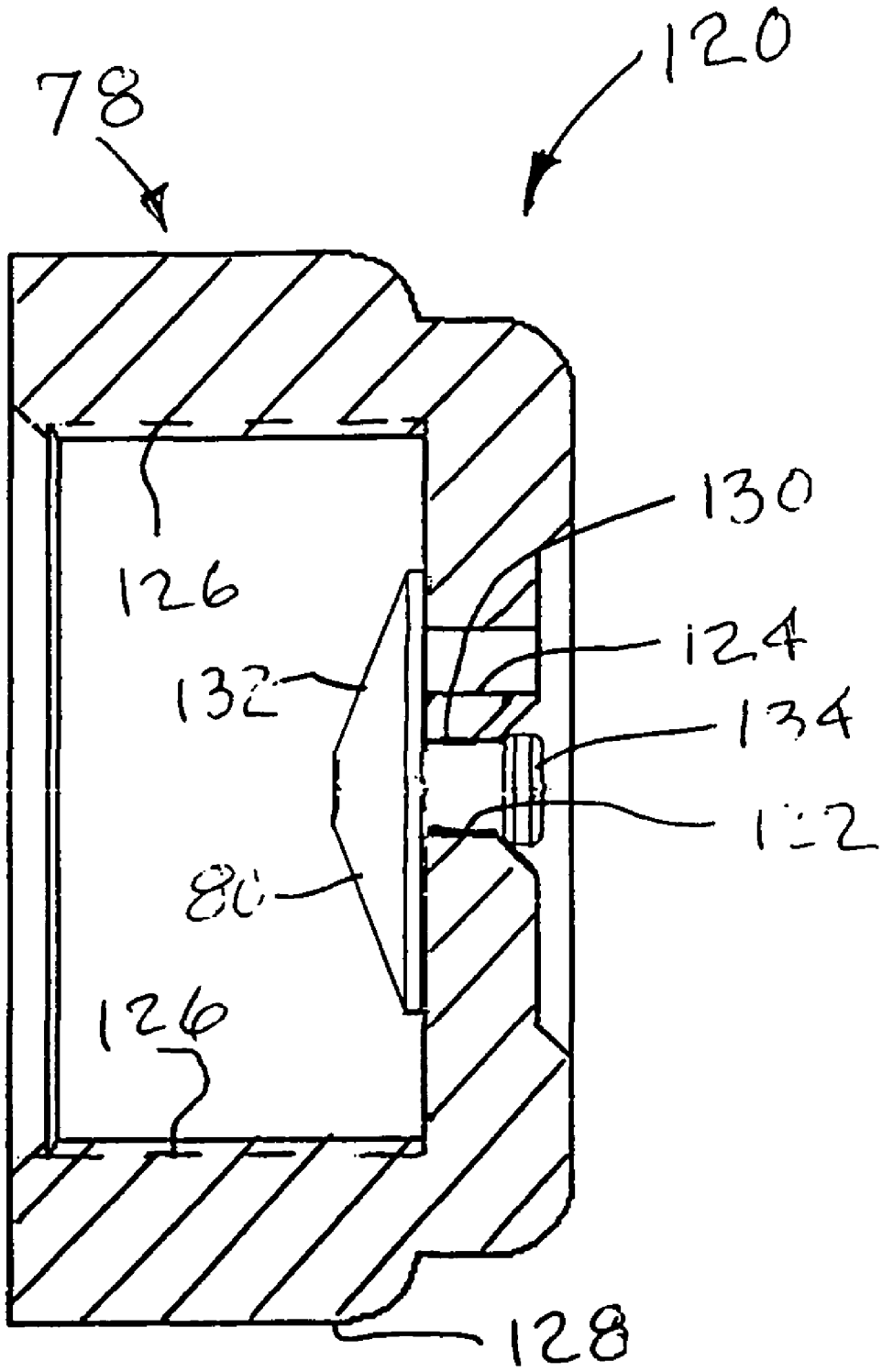
FIG. 25 is an assembly view, partly in section, of the breather valve element of FIG. 23 and the cap of FIG. 21.
Figure 26:
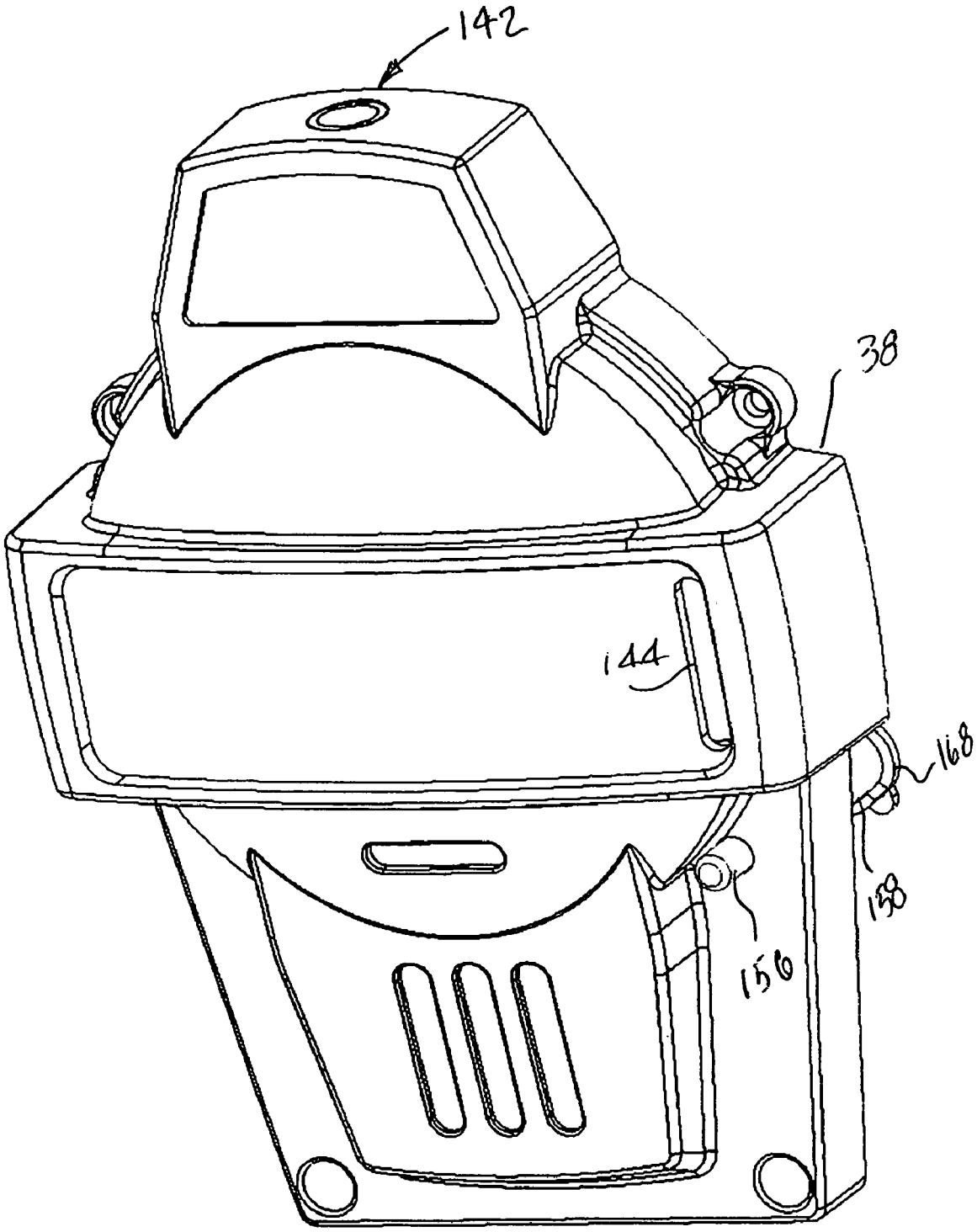
FIG. 26 is a perspective view from the front of an assembly of a cover of a piston pump with a second embodiment of the present invention.
Figure 27:
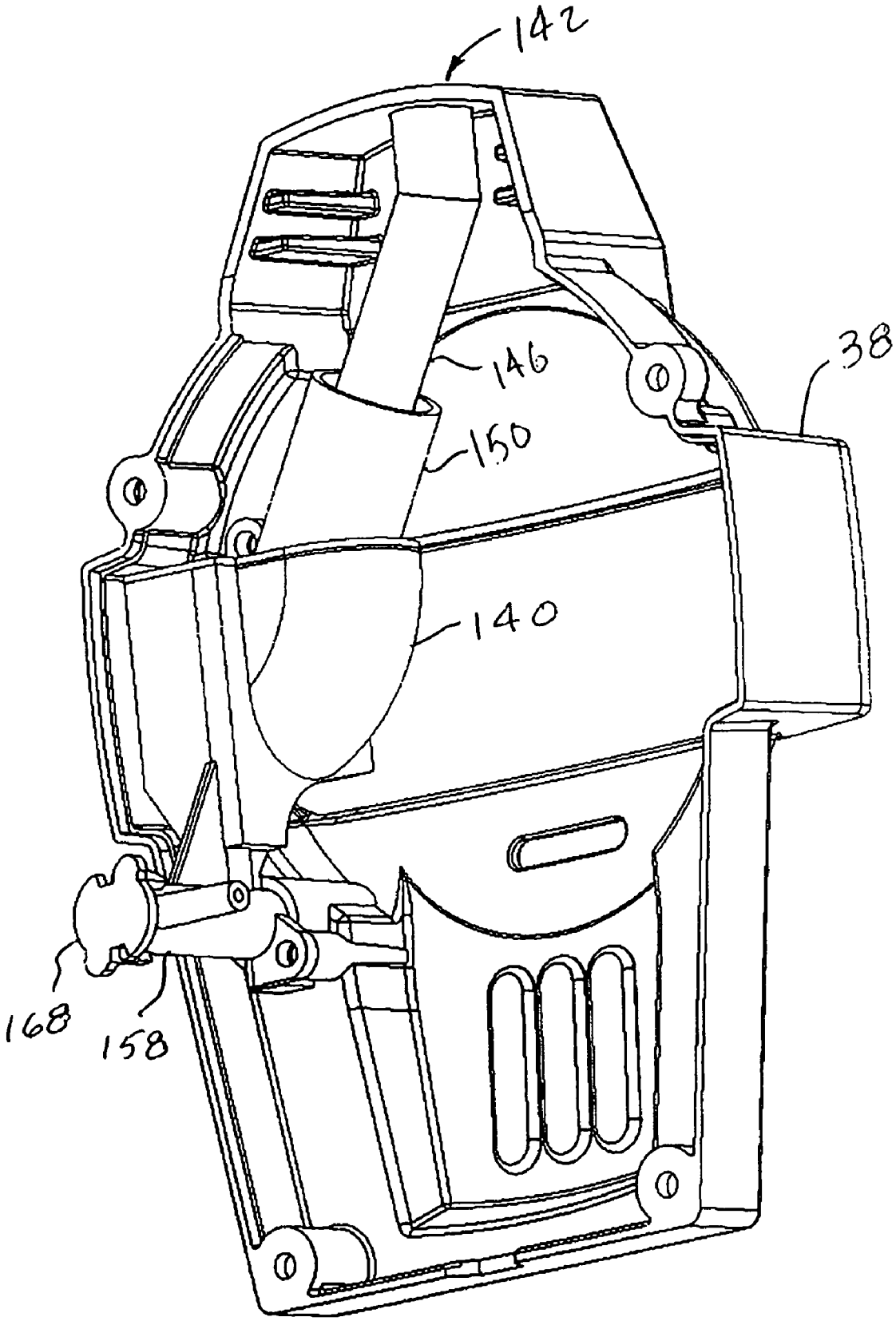
FIG. 27 is a perspective view from the rear and slightly below of the assembly of FIG. 26.
Figure 28:
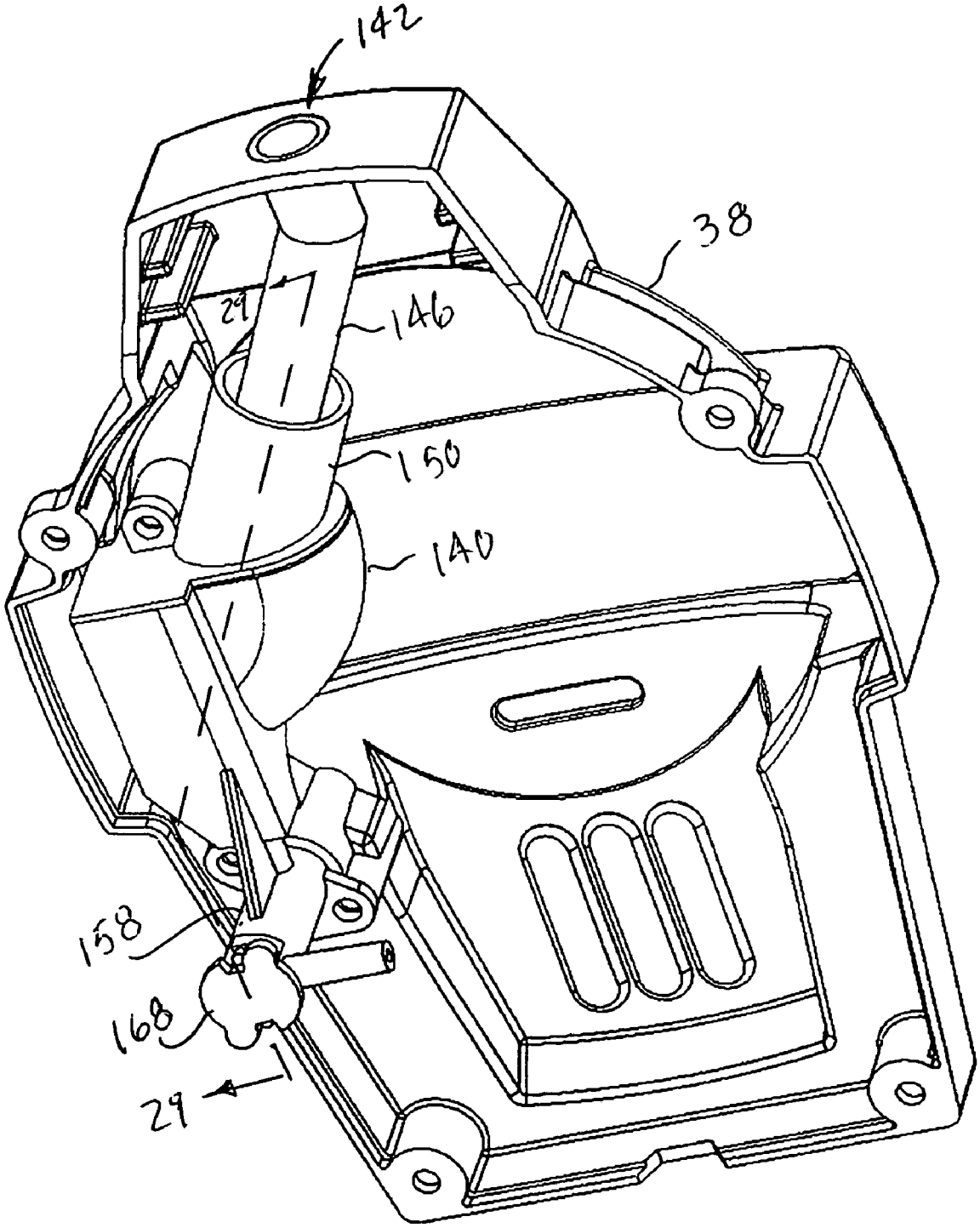
FIG. 28 is a perspective view from the rear and above of the assembly of FIG. 26.
Figure 29:
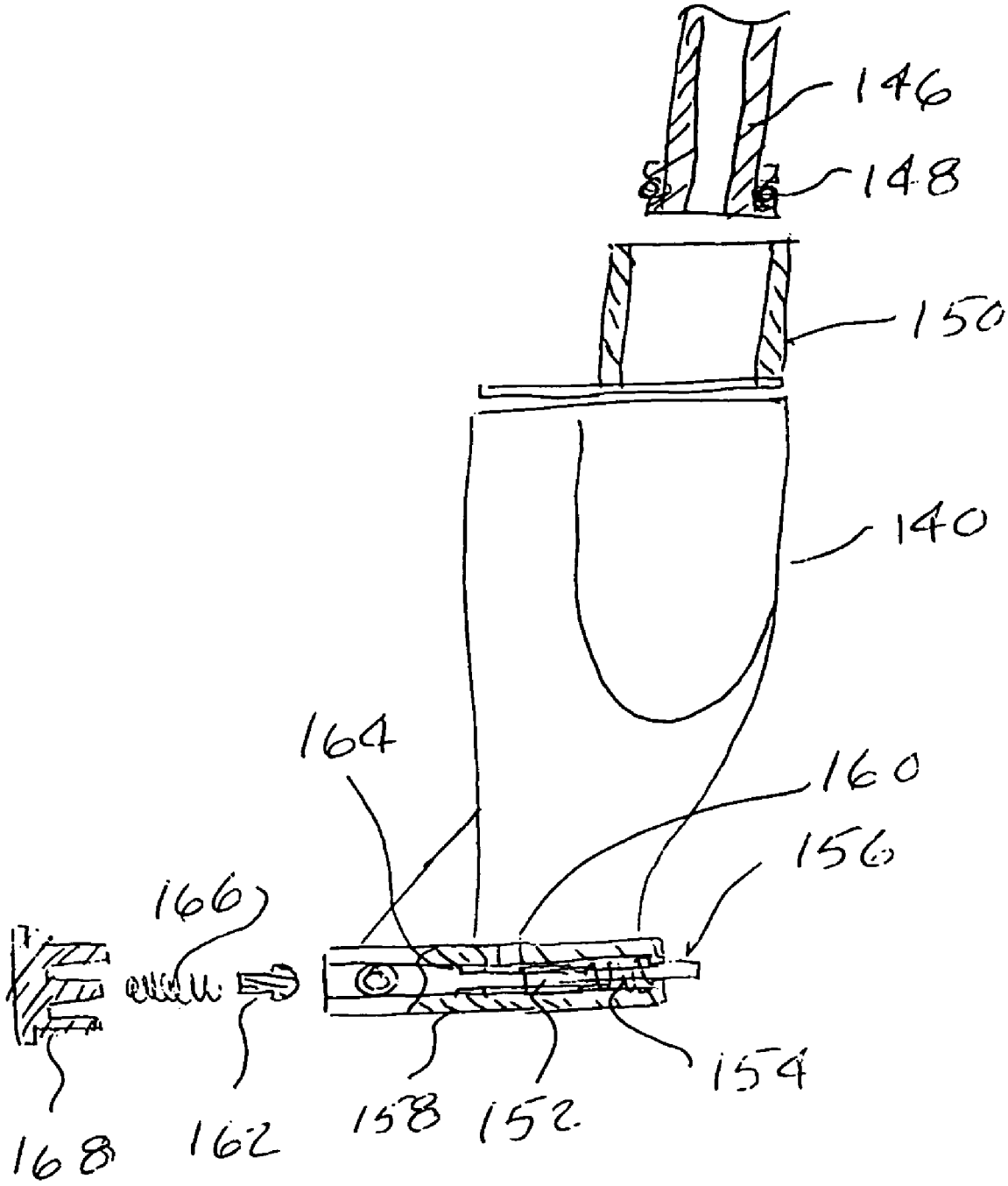
FIG. 29 is a partial section view of the lubrication delivery system of FIG. 28 taken along line 29-29.
Figure 30:
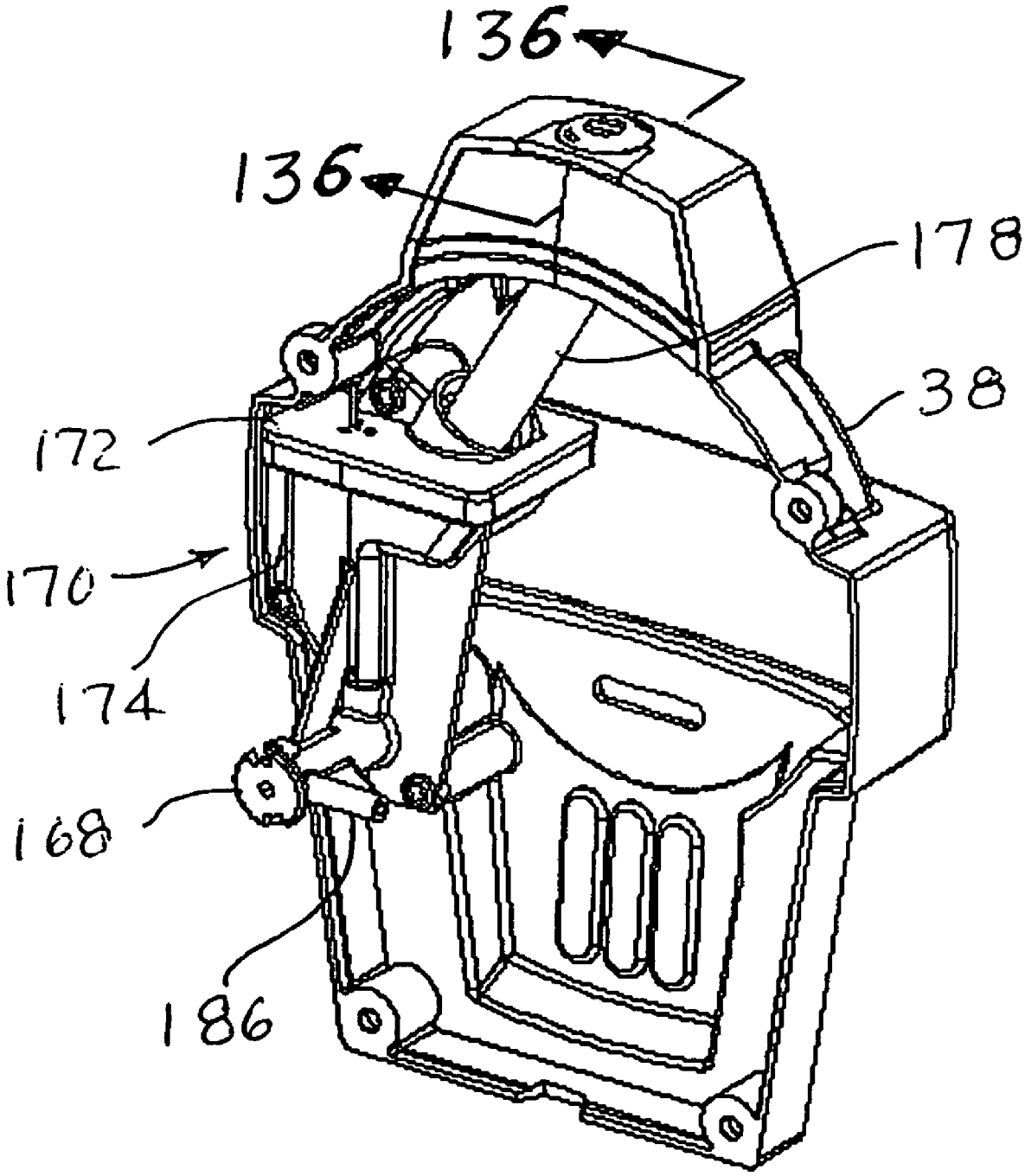
FIG. 30 is a rear perspective view from above of a third embodiment of the present invention installed in a cover of the piston pump.

Referring now most particularly to FIGS. 21-25, details of a breather valve and cap assembly 120 may be seen. Assembly 120 (shown in FIG. 25) is preferably made up of the cap 78 and breather valve 80. FIGS. 21 and 22 show a rear and section view, respectively of the cap 78, which has a central through bore 122 and an offset through bore or breather hole 124. Cap 78 has internal threads indicated by dashed line 126 sized to mate with external threads (not shown) on fitting 74. Cap 78 may also have flutes 128 projecting radially and extending axially on the exterior of cap 78. Cap 78 may be made of any suitable material, such as nylon Breather valve 80 is shown in a side view in FIG. 23, in a section view in FIG. 24, and is shown installed in cap 78 in FIG. 25. Breather valve 80 has a stem 130 connecting an umbrella-like flange 132 to an enlarged head 134. Breather valve 80 may be made of any suitable material sufficiently soft to function as a vacuum breaker valve, and is available as a fluorocarbon part from Vernay Laboratories, Inc. of 120 E. South College Street, Yellow Springs, Ohio 45387 as model VA 4687. In operation, flange 132 will lift away from cap 78 to permit ambient air to enter the lubricant reservoir 48 via breather hole 124 when lubricant is drawn from the reservoir 48 thus preventing a vacuum from forming in the reservoir 48.

Referring now to FIGS. 26, 27, 28 and 29, a second embodiment of the present invention may be seen. In this embodiment, a larger reservoir 140 (preferably formed of a transparent or translucent material, such as a polypropylene polymer) is used to store the lubricant. A fill fitting 142 is provided on the top of the cover 38, and may include a cap and breather as described above with respect to the first embodiment. With this embodiment, a window or opening 144 in cover 38 may be provided to enable a user to view the level of lubricant (typically oil) remaining in the reservoir. Fill tube 146 preferably has an 0-ring 148 to seal against a reservoir lid 150. A piston 152 has a spring 154 to return the piston to the rest position after an extension 156 is depressed to deliver lubricant as described above. In this embodiment, a cylinder 158 has an inlet port 160 closed when the piston 152 is actuated. A poppet 162 serves as an outlet check valve and is urged against a valve seat 164 by a spring 166 acting against poppet valve cap 168. The outlet tube delivers the lubricant to the interface between the paint pumping piston and its supporting bushing, as described above with respect to the first embodiment. It is to be understood that all materials in contact with the lubricant (typically a lubricating oil) must be compatible with and not degraded by the lubricant used.

Initially the reservoir 140 may be filled with separating oil, available from Wagner Spray Tech Corporation, 1440 Fernbrook Lane, Plymouth, Minn. 55447, as part number 0516915. Optionally, the reservoir may be refilled with light household oil, if desired.

Figure 31:
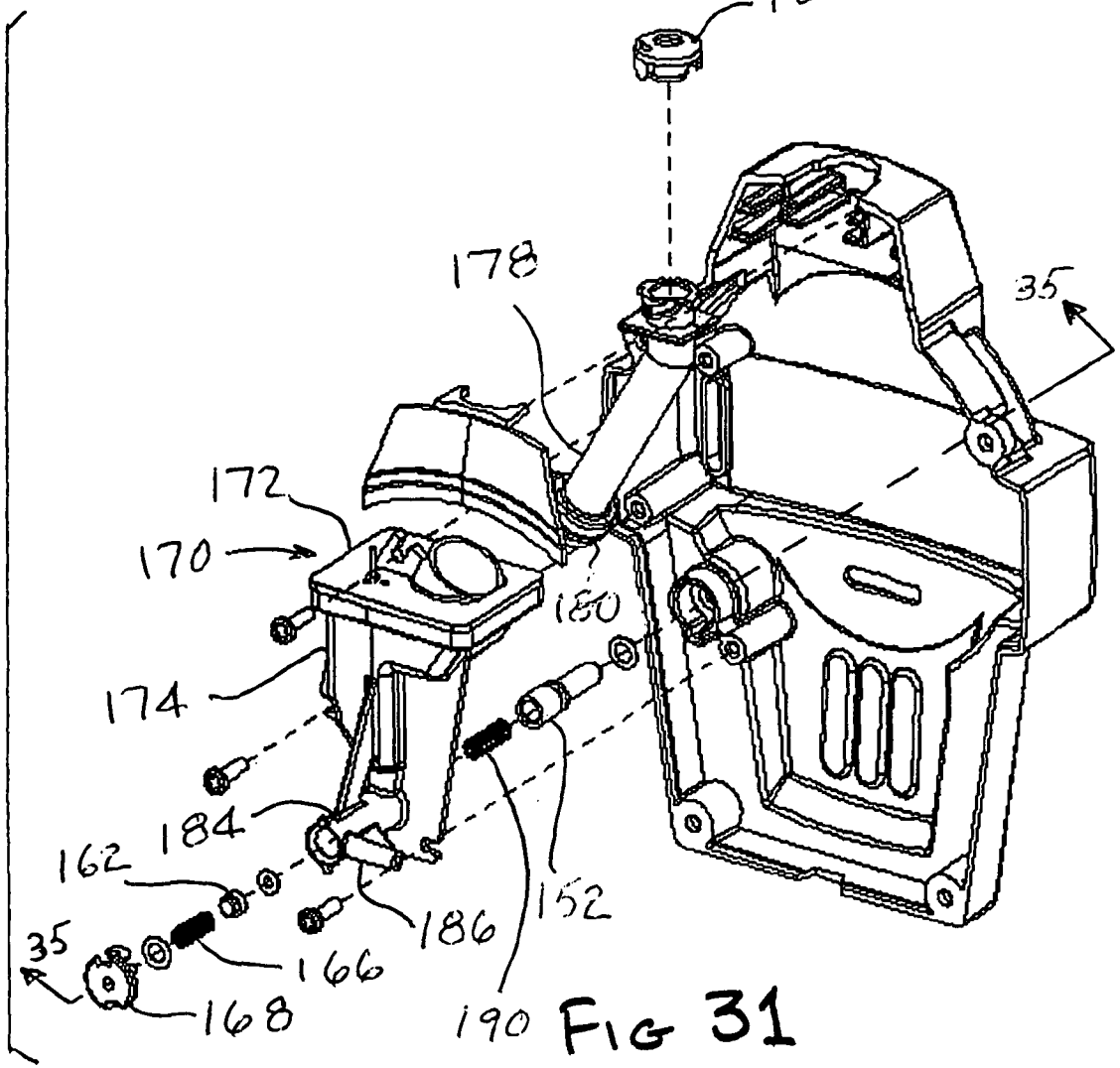
FIG. 31 is an exploded view of the parts of FIG. 30.
Figures 32, 33:
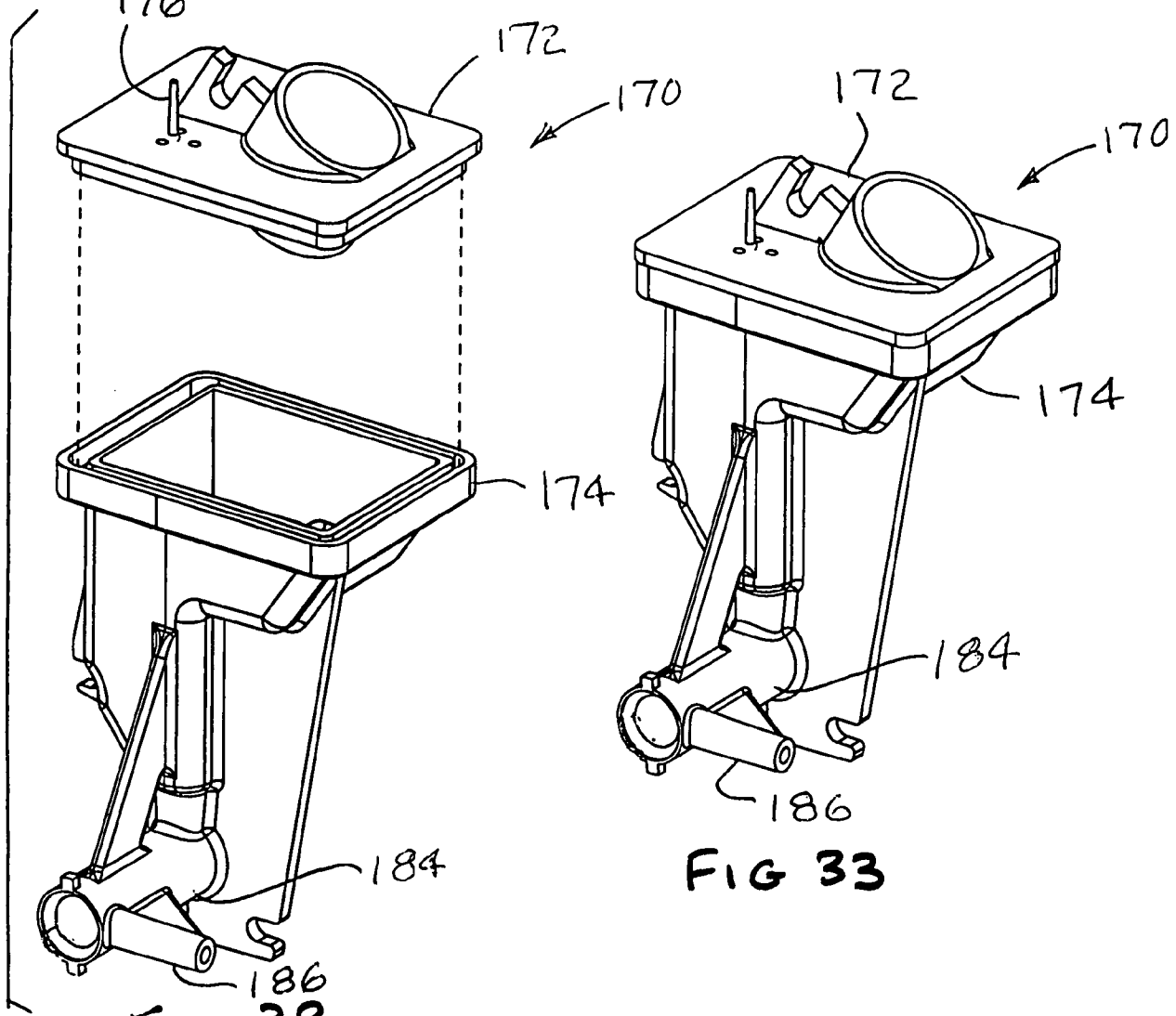
FIG. 32 is an exploded view of a lubricant reservoir and cover from FIG. 30.
FIG. 33 is a view of the parts of FIG. 32 secured together.
Figure 34:
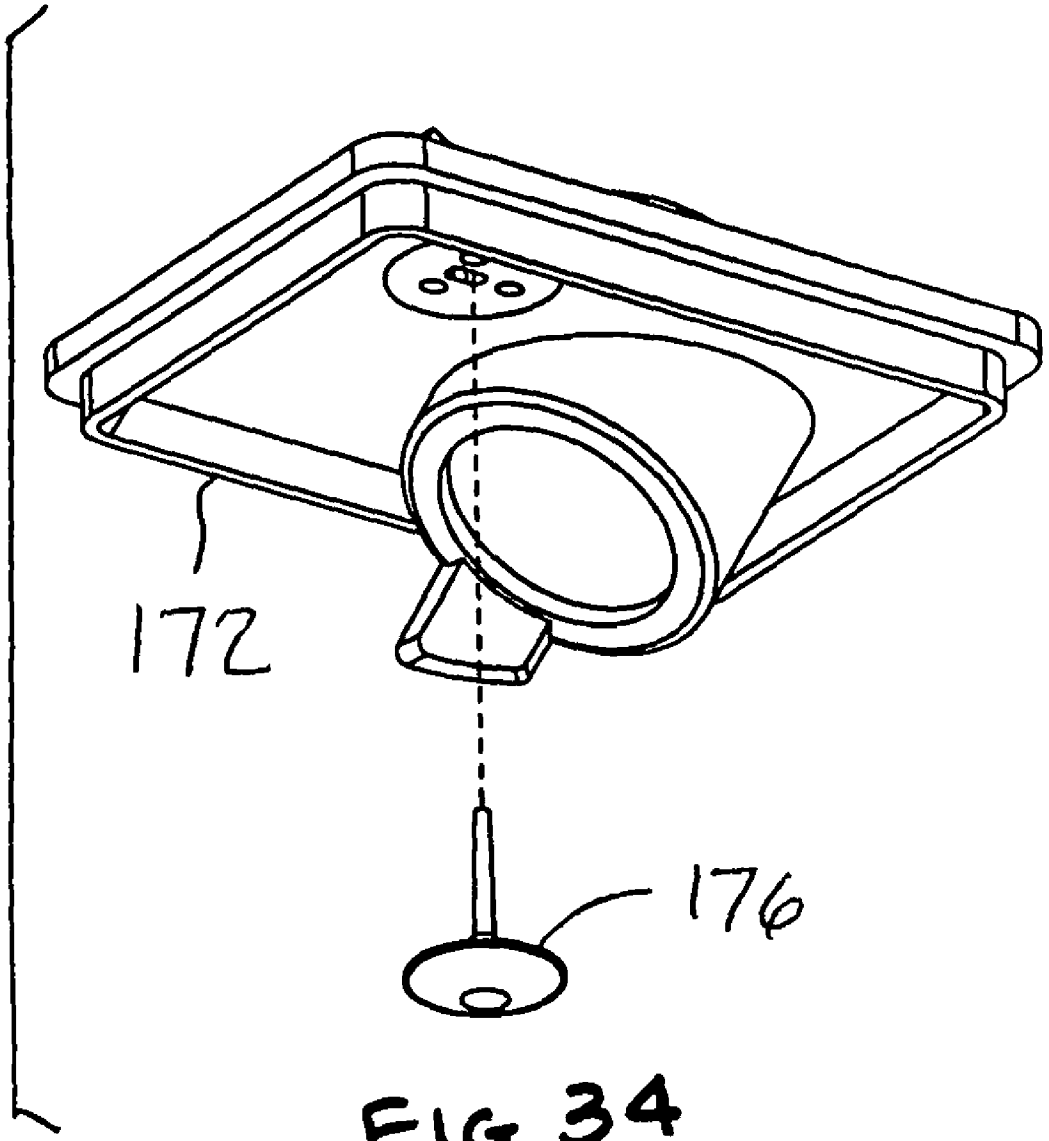
FIG. 34 is an exploded perspective view from below of a breather valve and cover of FIG. 32.
Figure 35:
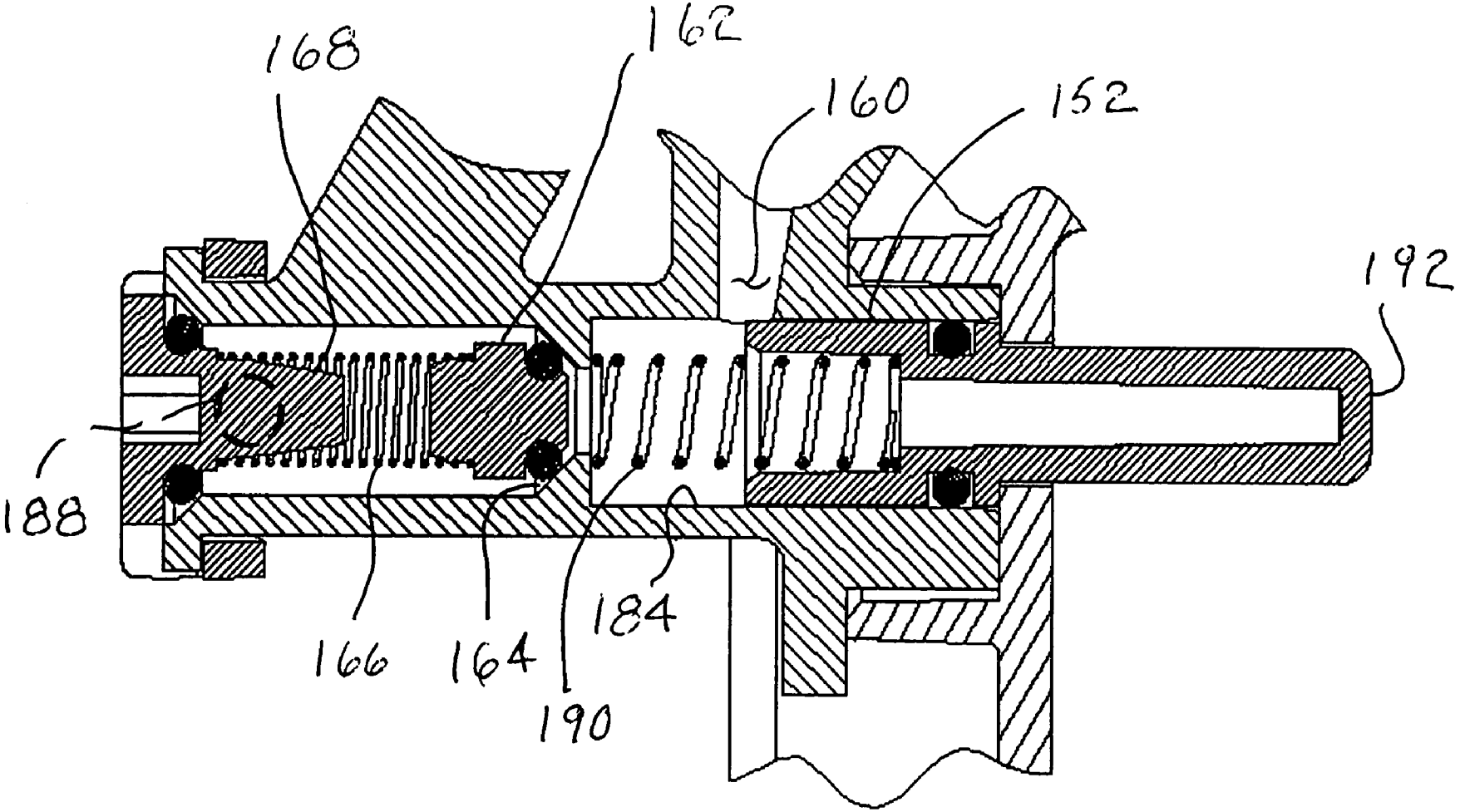
FIG. 35 is a fragmentary section view of the lubrication delivery system taken along line 35-35 of FIG. 31.

Referring now to FIGS. 30-35, a third embodiment of the present invention may be seen. In this embodiment (which is similar to the second embodiment) a reservoir 170 is preferably formed of a transparent or translucent polymer material, and may have a cover 172 permanently bonded to a main housing 174 (as shown in FIG. 33) after a breather valve 176 is installed, as shown in FIG. 34. With this embodiment the window or opening 144 in cover 38 may be provided as with the second embodiment. A fill tube 178 may have an O-ring 180 to seal the proximal end of the fill tube 178 against the reservoir cover 172. A fill tube cover 182 may be used to close the distal end of the fill tube after lubricant is stored in the reservoir. Referring most particularly to FIGS. 31 and 35, a cylinder 184 (corresponding to cylinder 158 in the second embodiment) has inlet port 160 closed by the piston 152 when the piston 152 is actuated. The piston moving in front of and blocking the inlet port serves as an inlet check valve in this embodiment. The poppet 162 serves as the outlet check valve and is urged against the valve seat 164 by spring 166 acting against poppet valve cap 168. The outlet tube 186 (whose position is represented by dashed circle 188 in FIG. 35) delivers the lubricant to the interface between the paint pumping piston and its supporting bushing, as described above with respect to the first and second embodiments. A spring 190 provides a return force for piston 152 when actuator or push-button end 192 of piston 152 is released by a user. The reservoir 170, cover 172, and fill tube 178 may each be made of a polypropylene polymer, while the fill tube cover 182, valve cap 168, poppet 162 and piston 152 may each be made of an acetal polymer, such as is available under the trademark Delrin from DuPont.

Figure 36:
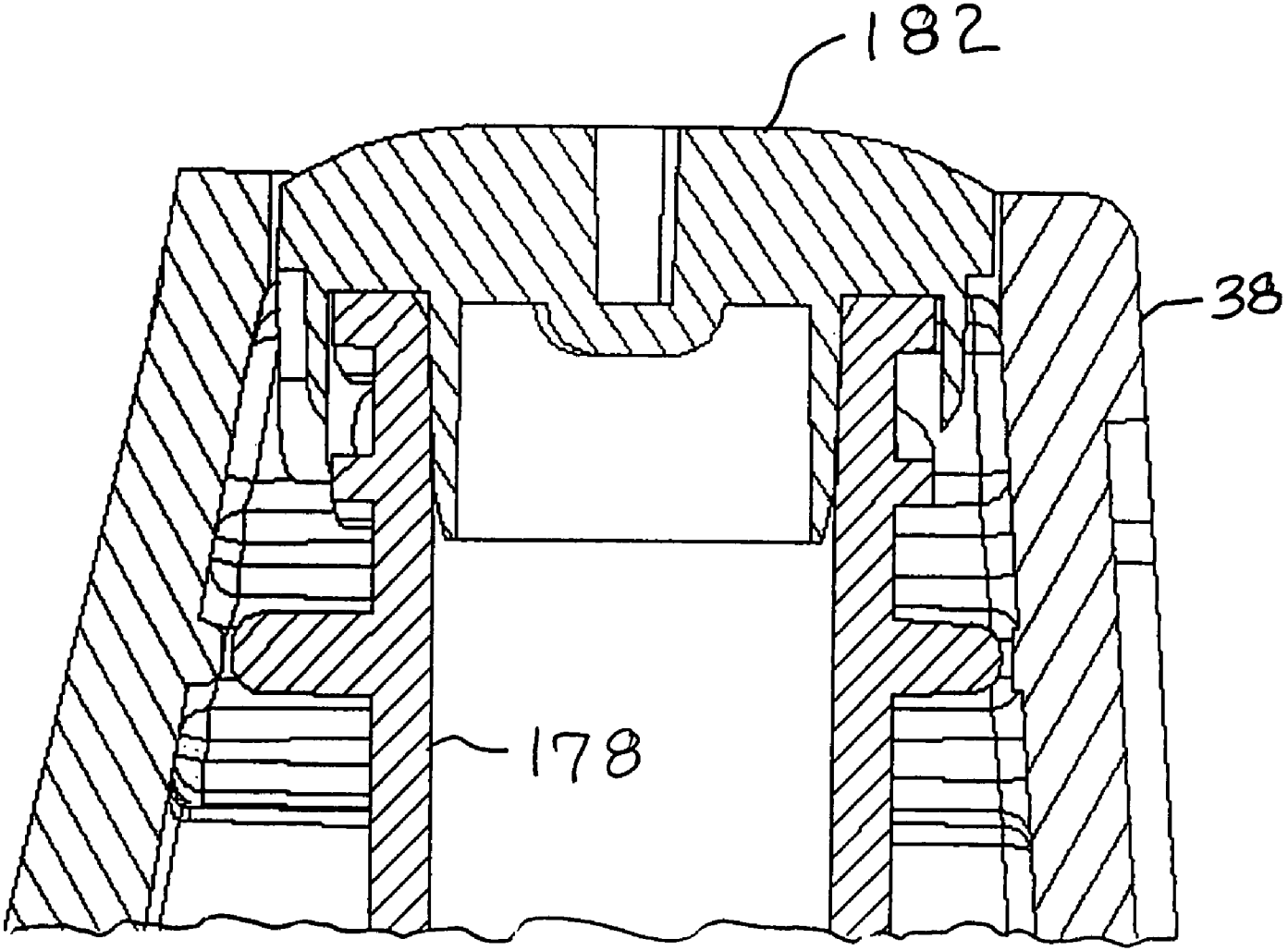
FIG. 36 is a fragmentary section view taken along line 136-136 of FIG. 30.
Figure 37:
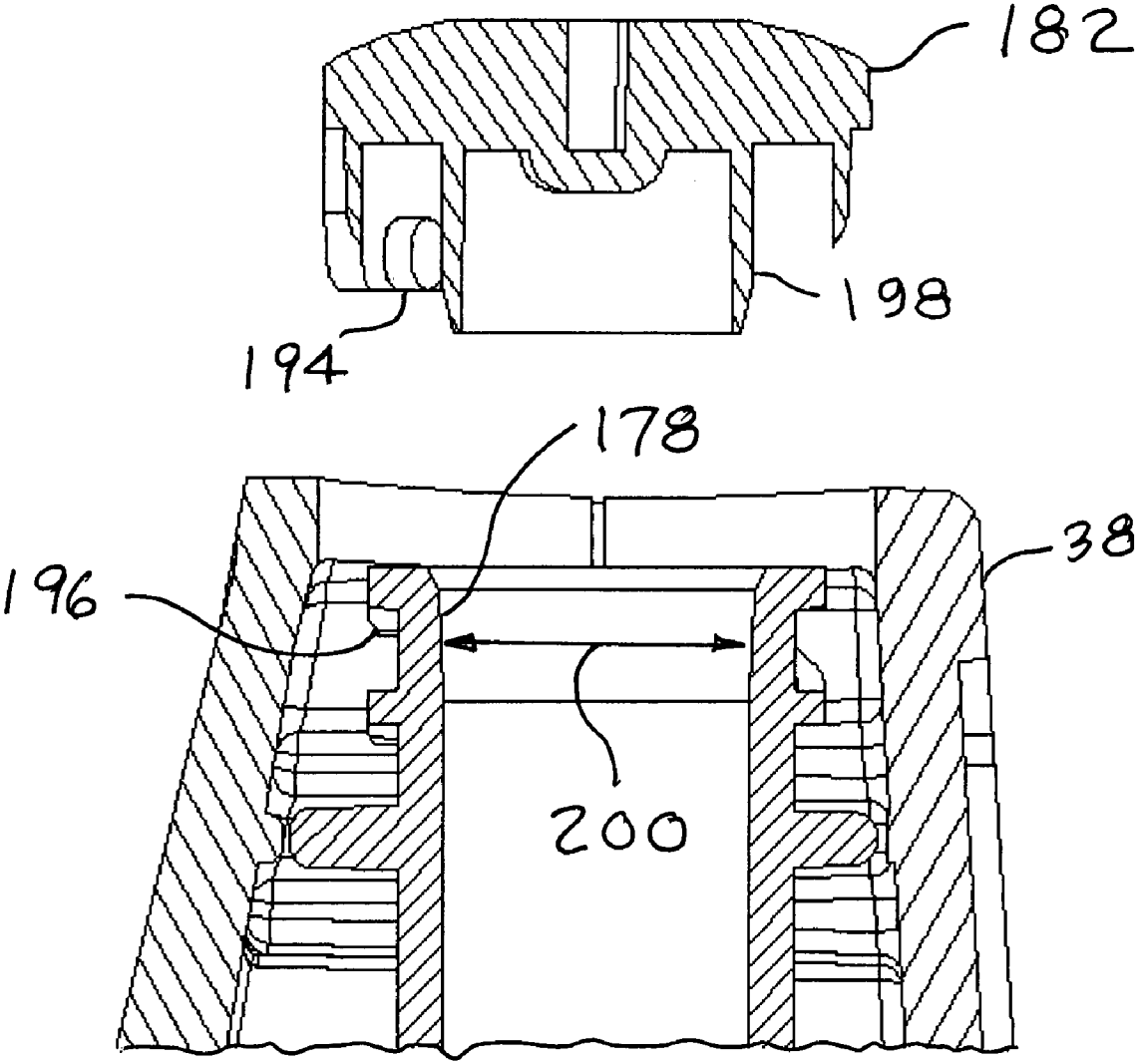
FIG. 37 is an exploded view corresponding to FIG. 36, showing a fill tube cover removed from a fill tube useful in the practice of the present invention.

Referring now most particularly to FIGS. 36 and 37, fragmentary section views with the fill tube cover 182 both installed and removed from the fill tube 178 may be seen. Cover 182 may have a slot to permit rotation using a conventional flat bladed screwdriver. When cover 182 is rotated, a pair of dogs are released from cam surfaces in an upper end of the fill tube 178. One dog 194 and a corresponding cam surface 196 may be seen in FIG. 37. It is to be understood that cover 182 has a flange 198 with an outside diameter that is sized to closely interfit with an inlet diameter of an inlet end of fill tube 178 to prevent leakage of liquid lubricant in the event that the paint pump is tipped or positioned to orientations other than as shown in FIG. 1, for example, for transportation or storage.

This invention is not to be taken as limited to all of the details thereof as modifications and variations thereof may be made without departing from the spirit or scope of the invention. For example and not by way of limitation, oil is the preferred lubricant for the practice of the present invention, however, other similar lubricants are to be included within the scope of the present invention.

What is claimed is:

1. An on-board lubrication assembly improvement in combination with a piston paint pump having a non-hydraulic powered paint pumping piston reciprocating in a bushing, the assembly improvement comprising:

a lubricant reservoir located internal to a housing of the pump having an inlet and an outlet;

an actuator extending exterior of the housing for manual activation by a user; and a lubricant dispensing mechanism having a lubricant delivery piston received within a cylinder, the lubricant delivery piston movable in response to manual actuation of the actuator, the lubricant dispensing mechanism including an inlet connected to the outlet of the reservoir and having an outlet connected to deliver a predetermined repeatable amount of lubricant to the paint pumping piston adjacent the bushing when the user manually actuates the actuator.

2. The assembly of claim 1 wherein the lubrication assembly further comprises:

an inlet check valve located between the reservoir and the lubricant dispensing mechanism; and an outlet check valve located downstream of the cylinder.

3. The assembly of claim 2 wherein the lubricant dispensing mechanism includes a return spring urging the lubricant delivery piston in a first direction in the cylinder, and the lubricant delivery piston is manually movable in a second direction in the cylinder.

4. The assembly of claim 3 wherein the lubricant delivery piston has a portion extending through an aperture in the housing and forming the actuator.

5. The assembly of claim 1 including a breather valve having an umbrella-like flange connected to a stem, the breather valve in fluid communication with the reservoir to prevent creation of a vacuum in the reservoir.

6. The assembly of claim 1 wherein the outlet of the lubricant dispensing mechanism includes an outlet adjacent to and directed at the paint pumping piston proximate the bushing.

7. The assembly of claim 1 further comprising a removable cover providing a liquid seal at the inlet of the lubricant reservoir wherein the cover has a pair of dogs releasable from a pair of cam surfaces in the inlet of the lubricant reservoir.

* * * * *